US010941592B2

(12) United States Patent
Taurasi

(10) Patent No.: US 10,941,592 B2
(45) Date of Patent: Mar. 9, 2021

(54) LATCH WITH DOUBLE ACTUATION AND METHOD OF CONSTRUCTION THEREOF

(71) Applicant: Magna Closures S.p.A., Guasticce (IT)

(72) Inventor: Marco Taurasi, Leghorn (IT)

(73) Assignee: Magna Closures Inc., Newmarket (CA)

( * ) Notice: Subject to any disclaimer, the term of this patent is extended or adjusted under 35 U.S.C. 154(b) by 742 days.

(21) Appl. No.: 15/156,494

(22) Filed: May 17, 2016

(65) Prior Publication Data

US 2016/0340941 A1 Nov. 24, 2016

Related U.S. Application Data

(60) Provisional application No. 62/165,015, filed on May 21, 2015.

(51) Int. Cl.
*E05B 83/24* (2014.01)
*E05B 77/08* (2014.01)
(Continued)

(52) U.S. Cl.
CPC ..... *E05B 83/24* (2013.01); *E05B 77/08* (2013.01); *E05B 77/10* (2013.01); *E05B 77/12* (2013.01);
(Continued)

(58) Field of Classification Search
CPC ..... E05B 3/24; E05B 83/243; E05B 83/247; E05B 83/26; E05B 77/08; E05B 77/10; E05B 77/12; E05B 79/10; E05B 79/20; Y10T 292/108; Y10T 292/1082; Y10T 292/1092; Y10T 292/1047; Y10S 292/23; Y10S 292/14
(Continued)

(56) References Cited

U.S. PATENT DOCUMENTS 3,504,511 A * 4/1970 Allen ..... E05B 47/0607 292/201
4,045,064 A * 8/1977 Okada ..... E05B 83/16 292/125
(Continued)

FOREIGN PATENT DOCUMENTS

DE 102007008700 A1 8/2008
DE 102009034904 A1 2/2011
(Continued)

*Primary Examiner* — Kristina R Fulton
*Assistant Examiner* — Faria F Ahmad
(74) *Attorney, Agent, or Firm* — Dickinson Wright PLLC

(57) ABSTRACT

A latch for a vehicle hood and method of construction thereof is provided. The latch includes a housing; a ratchet pivotally mounted on the housing and a pawl pivotally mounted on the housing for pivoting between a first position in locked engagement with the ratchet and a second position out of locked engagement with the ratchet, with the pawl being biased into the first position. A pawl lever is pivotally mounted on the housing to engage the pawl and rotate the pawl from the first position to the second position. A double pull lever having an abutment surface is pivotally mounted on the pawl lever. A safety catch member is pivotally mounted on the housing, wherein the safety catch member selectively engages the abutment surface of the double pull lever to pivot the safety catch member from a locked first position to an unlocked second position.

22 Claims, 25 Drawing Sheets

(51) Int. Cl.

| | |
|---|---|
| ***E05B 79/10*** | (2014.01) |
| ***E05B 79/20*** | (2014.01) |
| ***E05B 77/12*** | (2014.01) |
| ***E05B 77/10*** | (2014.01) |
| ***E05B 83/26*** | (2014.01) |

(52) U.S. Cl.
CPC ..... *E05B 79/10* (2013.01); *E05B 79/20* (2013.01); *E05B 83/243* (2013.01); *E05B 83/247* (2013.01); *E05B 83/26* (2013.01); *Y10S 292/14* (2013.01); *Y10S 292/23* (2013.01); *Y10T 292/081* (2015.04); *Y10T 292/108* (2015.04); *Y10T 292/1047* (2015.04); *Y10T 292/1082* (2015.04); *Y10T 292/1092* (2015.04)

(58) Field of Classification Search
USPC ..... 292/200, 201, 210, 216, DIG. 23, 292/DIG. 14
See application file for complete search history.

(56) References Cited

U.S. PATENT DOCUMENTS 4,875,724 A 10/1989 Gruber
5,137,311 A * 8/1992 Brackmann ..... E05B 81/14 292/216
5,150,933 A * 9/1992 Myslicki ..... E05B 83/16 292/216
5,247,817 A * 9/1993 Korner ..... E05B 63/20 292/DIG. 14
5,273,325 A * 12/1993 Zimmermann ..... E05B 81/22 292/216
5,288,115 A * 2/1994 Inoue ..... E05B 81/20 292/201
5,411,302 A * 5/1995 Shimada ..... E05B 81/14 292/201
5,423,582 A * 6/1995 Kleefeldt ..... E05B 81/20 292/201
5,445,421 A * 8/1995 Ferrara ..... E05B 83/24 292/216
5,474,338 A * 12/1995 Buscher ..... E05B 81/06 292/199
5,531,488 A * 7/1996 Yoshikuwa ..... E05B 63/0065 292/216
5,537,848 A * 7/1996 Grzanka ..... E05B 81/16 292/201
5,738,393 A * 4/1998 Chao ..... E05B 83/24 292/216
5,853,060 A * 12/1998 Chao ..... E05B 83/16 180/69.2
5,868,444 A * 2/1999 Brackmann ..... E05B 81/20 292/196
5,979,951 A * 11/1999 Shimura ..... E05B 85/26 292/216
6,092,845 A * 7/2000 Koenig ..... E05B 83/16 292/225
6,105,459 A * 8/2000 Troiano ..... B60T 7/047 74/512
6,149,210 A * 11/2000 Hunt ..... E05B 83/16 292/216
6,378,920 B1 * 4/2002 Ostrowski ..... E05B 83/16 292/216
6,485,071 B2 * 11/2002 Schwaiger ..... E05B 83/16 292/216
6,519,986 B2 * 2/2003 Wicker ..... E05B 81/06 292/201
6,540,271 B1 * 4/2003 Kalsi ..... E05B 81/14 292/216
6,547,291 B1 * 4/2003 Schwaiger ..... E05B 83/16 292/109
6,695,360 B1 * 2/2004 Forsell ..... E05B 83/16 292/201
7,111,878 B2 * 9/2006 Kachouh ..... E05B 81/14 292/201
7,195,090 B2 * 3/2007 Parks ..... B60R 21/38 180/271
7,380,844 B2 * 6/2008 Berghahn ..... E05B 81/20 292/201
7,559,399 B2 * 7/2009 Lewis ..... B60R 21/38 180/274
7,845,691 B2 * 12/2010 Sundararajan ..... B60R 21/38 180/274
8,235,428 B2 * 8/2012 Hunt ..... E05B 85/26 292/216
8,419,114 B2 * 4/2013 Fannon ..... E05B 83/24 180/69.2
8,534,720 B2 * 9/2013 Meyer ..... E05B 83/16 292/216
8,646,816 B2 * 2/2014 Dziurdzia ..... E05B 17/0029 292/201
8,757,679 B2 * 6/2014 Torkowski ..... E05B 81/14 292/201
8,827,329 B2 * 9/2014 Scholz ..... E05B 85/26 292/216
8,844,984 B2 * 9/2014 Kurebayashi ..... E05B 81/20 292/201
8,876,176 B2 * 11/2014 Spurr ..... E05B 81/14 292/201
9,187,936 B2 * 11/2015 Kim ..... E05B 83/24
9,243,429 B2 * 1/2016 Bendel ..... E05B 77/06
9,255,429 B2 * 2/2016 Kim ..... E05B 83/24
9,273,497 B2 * 3/2016 Torka ..... E05B 77/36
9,284,757 B2 * 3/2016 Kempel ..... E05B 83/26
9,403,487 B1 * 8/2016 Diehl ..... B62D 25/12
9,512,650 B2 * 12/2016 Faruque ..... E05B 77/08
9,534,428 B2 * 1/2017 Kim ..... E05B 83/24
10,035,490 B2 * 7/2018 Kim ..... E05B 77/08
10,273,726 B2 4/2019 Park et al.
2006/0028029 A1 * 2/2006 Spurr ..... E05B 81/20 292/216
2006/0170224 A1 * 8/2006 Mitchell ..... E05B 77/04 292/216
2006/0226661 A1 * 10/2006 Moore ..... E05B 81/20 292/216
2007/0200359 A1 * 8/2007 Lewis ..... B60R 21/38 292/216
2008/0224482 A1 * 9/2008 Cumbo ..... E05B 77/02 292/216
2010/0052336 A1 * 3/2010 Bendel ..... E05B 85/26 292/196
2010/0244466 A1 * 9/2010 Tomaszewski ..... E05B 77/26 292/201
2012/0043766 A1 * 2/2012 Nurmi ..... E05B 77/44 292/126
2012/0074715 A1 * 3/2012 Kim ..... B60R 21/34 292/201
2012/0139269 A1 * 6/2012 Kouzuma ..... E05B 81/14 292/195
2012/0161453 A1 * 6/2012 Zysk ..... E05B 83/24 292/21
2012/0161456 A1 * 6/2012 Riedmayr ..... E05B 83/24 292/226
2012/0181798 A1 * 7/2012 Margheritti ..... E05B 77/32 292/200
2013/0238187 A1 * 9/2013 Zysk ..... E05B 81/56 701/36
2013/0300134 A1 * 11/2013 Jayasuriya ..... E05B 77/08 292/129
2013/0313036 A1 * 11/2013 Kovie ..... E05B 77/06 180/274
2014/0013667 A1 * 1/2014 Amagai ..... E05B 79/20 49/301
2014/0062098 A1 * 3/2014 Kim ..... E05B 83/24 292/28
2014/0076094 A1 * 3/2014 Mori ..... E05B 79/20 74/502.2
2014/0138961 A1 * 5/2014 Hwang ..... E05B 83/24 292/122

(56) References Cited

U.S. PATENT DOCUMENTS

2014/0159386 A1* 6/2014 Faruque ..... E05B 77/08 292/196
2014/0203570 A1* 7/2014 Nass ..... E05B 79/20 292/196
2014/0210220 A1* 7/2014 Limberg ..... E05B 83/24 292/216
2014/0246870 A1* 9/2014 Kim ..... E05B 83/24 292/216
2014/0284945 A1* 9/2014 Wittelsbuerger ..... E05B 77/06 292/126
2014/0319847 A1* 10/2014 Uehara ..... E05B 77/26 292/97
2014/0319848 A1* 10/2014 Fannon ..... E05B 83/24 292/122
2014/0352216 A1* 12/2014 Kapustnyk ..... E05B 81/06 49/31
2014/0361554 A1* 12/2014 Ferri ..... E05B 83/24 292/200
2015/0054293 A1* 2/2015 Kim ..... E05B 77/08 292/92
2015/0102607 A1* 4/2015 Kim ..... B62D 25/12 292/92
2015/0115625 A1* 4/2015 Park ..... E05B 83/24 292/194
2015/0115628 A1* 4/2015 Wittelsbuerger ... E05B 63/0056 292/200
2015/0145262 A1* 5/2015 Gotzen ..... E05B 77/10 292/194
2015/0145263 A1* 5/2015 Farris ..... E05B 83/24 292/195
2015/0218857 A1* 8/2015 Hamada ..... E05B 85/20 292/194
2015/0284977 A1* 10/2015 Barmscheidt ..... E05B 81/14 292/200
2015/0308156 A1* 10/2015 Hunt ..... E05B 79/20 292/201
2015/0345185 A1* 12/2015 Farooq ..... E05B 79/20 292/194
2015/0345186 A1* 12/2015 Park ..... E05B 83/24 292/194
2015/0345187 A1* 12/2015 Kwon ..... E05B 83/24 292/44
2015/0354255 A1* 12/2015 Wittelsbuerger ..... F16C 1/145 292/336.3
2016/0002959 A1* 1/2016 Javadzadeh ..... E05B 77/12 701/46
2016/0010364 A1* 1/2016 Hanaki ..... E05B 83/40 292/21
2016/0010365 A1* 1/2016 Hanaki ..... E05B 81/14 292/21
2016/0017644 A1* 1/2016 Okuma ..... E05B 81/20 292/201
2016/0076279 A1* 3/2016 Ilea ..... E05B 83/24 292/220
2016/0130842 A1* 5/2016 Ferri ..... E05B 77/08 292/92
2016/0145894 A1* 5/2016 Jeong ..... E05B 77/54 292/195
2016/0168883 A1* 6/2016 Konchan ..... E05B 83/24 292/197
2016/0168884 A1* 6/2016 Hillgaertner ..... B60J 7/19 292/196
2016/0177602 A1* 6/2016 Graute ..... E05B 79/20 74/424.71
2016/0186458 A1* 6/2016 Balakrishna ..... E05B 79/20 292/336.3
2016/0186468 A1* 6/2016 Ilea ..... E05B 79/04 292/201
2016/0201361 A1* 7/2016 Hanaki ..... E05B 81/16 292/200
2016/0215536 A1* 7/2016 Cumbo ..... E05B 77/36
2016/0245010 A1* 8/2016 Makino ..... E05F 15/643
2016/0258193 A1* 9/2016 Rosales ..... E05B 77/06
2016/0258194 A1* 9/2016 Rosales ..... E05B 77/06
2016/0281400 A1* 9/2016 Byun ..... E05B 79/20
2016/0312500 A1* 10/2016 Hiramoto ..... E05B 81/90
2016/0362917 A1* 12/2016 Cumbo ..... E05C 19/022
2016/0369533 A1* 12/2016 Nagaoka ..... E05B 79/20
2017/0036642 A1* 2/2017 Nomura ..... B62D 25/12
2017/0058575 A1* 3/2017 Farooq ..... E05B 47/0001
2017/0089105 A1* 3/2017 Margheritti ..... E05B 79/20
2017/0089112 A1* 3/2017 Rosales ..... B62D 33/037
2017/0234039 A1* 8/2017 Taga ..... E05B 85/02 292/337
2017/0254354 A1* 9/2017 Carabalona ..... E05B 53/005
2017/0260779 A1* 9/2017 Tamura ..... B60J 5/04
2017/0268265 A1* 9/2017 Hiramoto ..... E05B 81/74
2017/0292297 A1* 10/2017 Bartels ..... E05B 85/107
2017/0298657 A1* 10/2017 Lei ..... E05B 77/04
2017/0298662 A1* 10/2017 Shibayama ..... E05B 81/14
2017/0313166 A1* 11/2017 Sugie ..... B60J 5/0429
2017/0314303 A1* 11/2017 Nagata ..... B60J 5/00
2017/0321456 A1* 11/2017 Jeong ..... E05B 15/04
2018/0030763 A1* 2/2018 Distefano ..... E05B 77/54
2018/0038140 A1* 2/2018 McCarthy ..... E05B 81/90
2018/0051495 A1* 2/2018 Shibayama ..... B60J 5/047
2018/0058116 A1* 3/2018 Erices ..... E05B 79/20
2018/0073282 A1* 3/2018 Takagi ..... E05B 81/16
2018/0080262 A1* 3/2018 Takagi ..... E05B 17/00
2018/0106079 A1* 4/2018 Alacqua ..... E05B 47/0009
2018/0106080 A1* 4/2018 Otto ..... B60J 5/06
2018/0112442 A1* 4/2018 Enomoto ..... E05B 77/265
2018/0112444 A1* 4/2018 Kuwabara ..... E05B 79/20
2018/0142504 A1* 5/2018 Hwang ..... E05B 79/16
2018/0178637 A1* 6/2018 Brion ..... E05F 15/632
2018/0230716 A1* 8/2018 Schiffer ..... E05B 77/10
2018/0230718 A1* 8/2018 Menke ..... E05B 63/244
2018/0252004 A1* 9/2018 Bishop ..... E05B 81/18
2018/0252007 A1* 9/2018 Krause ..... E05B 63/24
2018/0266150 A1* 9/2018 Nottebaum ..... E05B 81/16

FOREIGN PATENT DOCUMENTS

DE 102009037037 A1 2/2011
GB 907930 A 10/1962
WO 2013127002 A1 9/2013

* cited by examiner

FIG. 2K
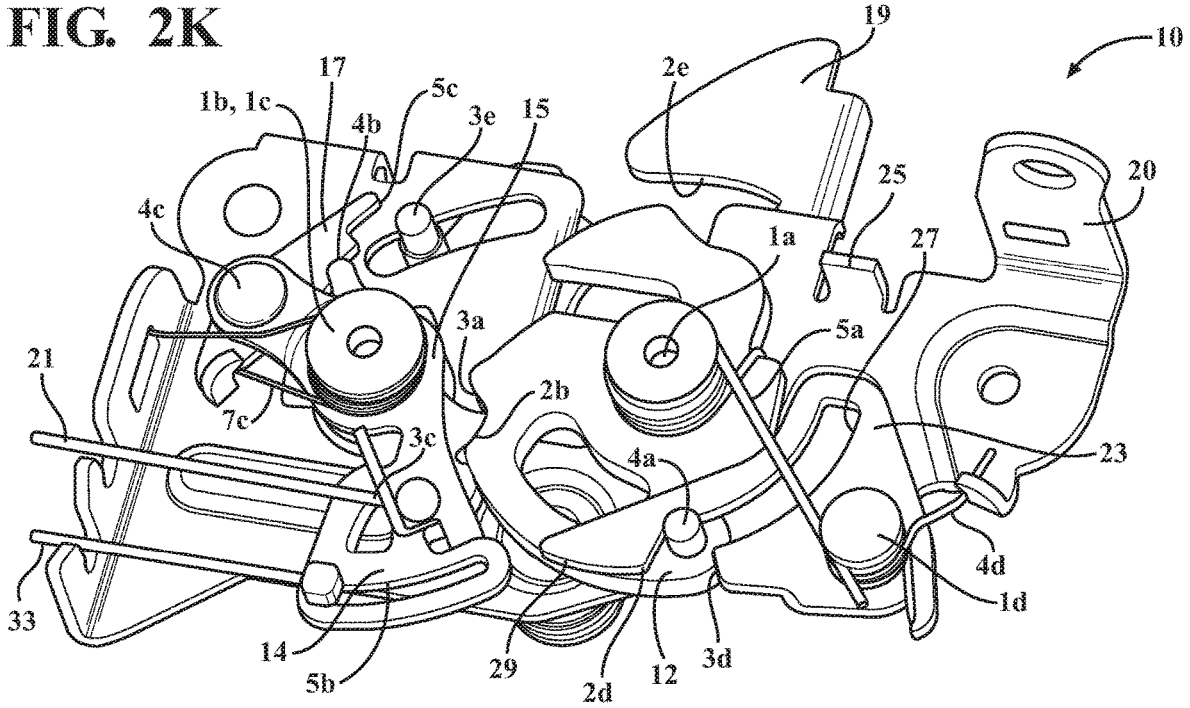
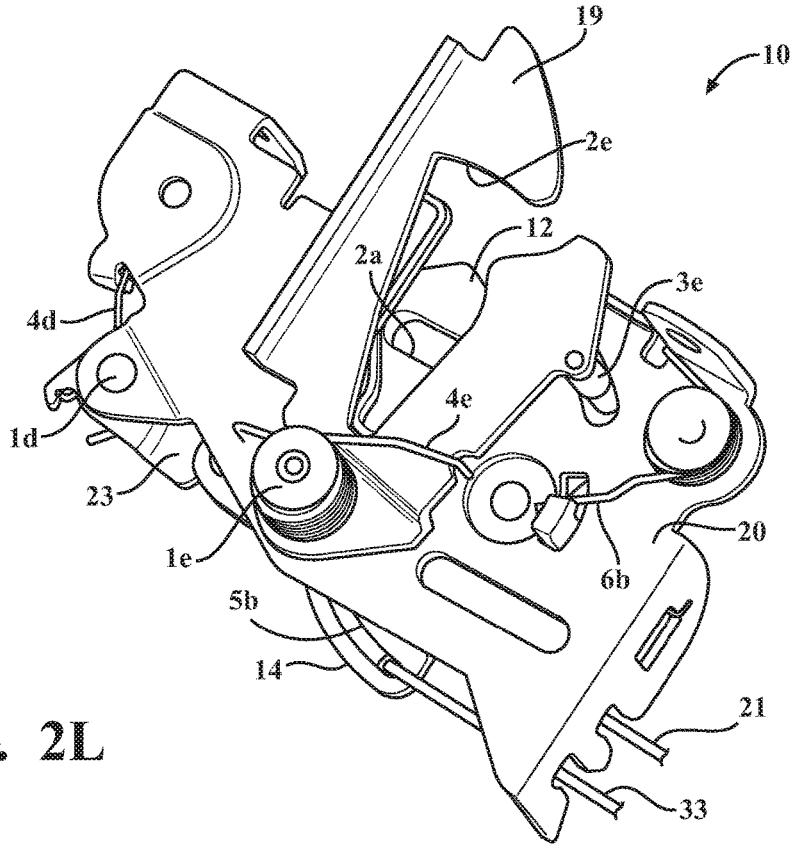
FIG. 2L

LATCH WITH DOUBLE ACTUATION AND METHOD OF CONSTRUCTION THEREOF

CROSS-REFERENCE TO RELATED APPLICATION

This application claims the benefit of U.S. Provisional Application Ser. No. 62/165,015, filed May 21, 2015, which is incorporated herein by reference in its entirety.

FIELD OF THE INVENTION

The present disclosure relates to latches for closure panels and more particularly to vehicle hood latches.

BACKGROUND OF THE INVENTION

Latches for vehicle hoods and the like are typically actuated in two stages. During a first stage a handle is actuated inside the vehicle which moves the latch from a primary closed position to secondary closed position. To release the latch completely the vehicle occupant typically must exit the vehicle and manually actuate a latch lever that is under the hood. This may be inconvenient in some situations.

In terms of lifting a hood in general, and specifically for an active pedestrian protection system, the latch is needed to provide a travel that is greater than that which is used for normal opening. Due to mechanical limitations of springs and targets for mass and packaging, the normal opening lift of the hood cannot be as high as compared to what is provided using the active pedestrian protection system.

The automotive industry is attempting to better protect pedestrians from head on collisions with vehicles. When a car hits a pedestrian in a front collision, the pedestrian can be thrown up and land on the front hood of the vehicle and/or the windshield. In an effort to lessen the harshness of the impact, and in particular to prevent the person's head from hitting the engine block or other hard point located directly underneath the hood, it is desired to actively space the hood from the engine block whenever a front end collision is detected.

It is widely recognized that the hood latch is positioned on the frontal area of the vehicle, on a YZ plane, such that a longitudinal axis of a body of the striker is positioned along the X axis extending from a front end to the rear end of the vehicle, with the Y axis extending between the opposite sides of the vehicle, and the Z axis extending vertically and transversely to the XY plane. The current state of the art provides a safety catch lever integrated into the hood latch; however, a vehicle occupant must complete two different operations to release the hood, either by themselves, or with the assistance of a person outside the vehicle, namely, pulling a latch pull mechanism from inside the vehicle, typically beneath a dashboard, and manually releasing the safety catch lever from outside of the vehicle placing a hand under the hood and grasping the safety catch lever to move it out of engagement with the striker in order to completely release the safety catch lever from the striker. Not only can this be cumbersome, but it can be difficult on occasion to locate the safety catch lever, thereby causing frustration while attempting to open the hood.

In the current art, accommodation of manufacturing tolerances for the striker extending along the X-axis direction is provided by adjusting the length of the striker body along its length, which extends along the X-axis. Further, some vehicles include two hood latches positioned on XZ plane adjacent opposite sides of the vehicle, with the safety catch mechanism and lever remaining on the front of the vehicle separate from and between the hood latches. Accordingly, the problem remains in that the safety catch must be manually and directly actuated by a person reaching under the hood.

SUMMARY OF THE INVENTION

In accordance with one aspect of the invention, a latch for a vehicle hood is provided. The latch includes a housing; a ratchet mounted on the housing for pivoting about a first pivot axis; a pawl mounted on the housing for pivoting about a second pivot axis between a first position in locked engagement with said ratchet and a second position out of locked engagement with said ratchet, with the pawl being biased into the first position. A pawl lever is mounted on the housing for pivoting about a third pivot axis. The pawl lever is configured to engage the pawl to rotate the pawl about the second pivot axis from the first position to the second position. A double pull lever is mounted on the pawl lever for pivoting about a fourth pivot axis, with the double pull lever having an abutment surface. A safety catch member is mounted on the housing for pivoting movement about a fifth pivot axis. The safety catch member is configured for selective engagement with the abutment surface of the double pull lever to pivot the safety catch member from a locked first position to an unlocked second position.

In accordance with another aspect of the invention, the third pivot axis and the fourth pivot axis are spaced apart from one another along the pawl lever.

In accordance with another aspect of the invention, a first linkage is connected to the pawl lever, with the first linkage being configured to act on the pawl lever to rotate the pawl from the first position to the second position through a first actuation of the first linkage.

In accordance with another aspect of the invention, the first linkage is configured to act on the pawl lever through a second actuation of the first linkage to drive the double pull lever about the third pivot axis to pivot the safety catch member about the fifth pivot axis and move the safety catch member from the locked first position to the unlocked second position, thereby allowing the latch to be fully unlocked via the first linkage.

In accordance with another aspect of the invention, a second linkage can be connected to the pawl, with the second linkage being configured to act on the pawl to rotate the pawl from the first position to the second position through a first actuation of the second linkage.

In accordance with another aspect of the invention, the second linkage is configured for automated actuation to automatically cause the second linkage to act on the pawl independent from the first linkage.

In accordance with another aspect of the invention, the first linkage is manually actuatable.

In accordance with another aspect of the invention, a contact surface extending from a body of the pawl is configured to selectively inhibit the engagement of the abutment surface of the double pull lever with the safety catch member, thereby controlling when the safety catch member can become biased to an unlocked position.

In accordance with another aspect of the invention, the ratchet has an abutment surface and further including a blocking member mounted on the housing for pivoting about an axis spaced from the second pivot axis, with the blocking member having a blocking surface configured to confront the abutment surface to inhibit pivoting of the ratchet.

In accordance with another aspect of the invention, the blocking member has an elongate slot adjacent the abutment surface, with the elongate slot being configured to receive the abutment when the ratchet pivots past a closed position of the latch.

In accordance with another aspect of the invention, the blocking member has an arcuate surface at a leading end of the slot for guiding the abutment in to and out of the slot.

In accordance with another aspect of the invention, a latch for a vehicle hood has a housing; a ratchet mounted on the housing and being pivotal about a first pivot axis; a pawl mounted on the housing, with the pawl being pivotal about a second pivot axis into biased engagement with the ratchet; a pawl lever mounted on the housing, with the pawl lever being pivotal about a third pivot axis for engagement with the pawl to rotate the pawl about the second pivot axis; a first linkage is coupled to the pawl lever, with the first linkage being actuatable to disengage the pawl from the ratchet during a first actuation of the first linkage; and a second linkage is coupled to the pawl, with the second linkage being operable to disengage the pawl from the ratchet through a first actuation of the second linkage independent of the first linkage.

In accordance with another aspect of the invention, a double pull lever is mounted on the pawl lever and a safety catch member is mounted on the housing, with the double pull lever being pivotal about a fourth pivot axis in response to a second actuation of the first linkage to bring the double pull lever into operable engagement with the safety catch member to pivot the safety catch member about a fifth pivot axis.

In accordance with another aspect of the invention, a latch for a vehicle hood has a housing; a ratchet mounted on the housing for pivoting about a first pivot axis; a pawl mounted on the housing for pivoting about a second pivot axis and biased into engagement with the ratchet; and a blocking member mounted on the housing for pivoting about a third pivot axis and biased into engagement with the ratchet, the second pivot axis and the third pivot axis being spaced apart from one another, the blocking member having a command surface for interacting with an abutment of the ratchet, a blocking surface for inhibiting pivoting of the ratchet when in contact with the abutment, and a slot extending along a body of the blocking member for receiving the abutment when the ratchet pivots past a closed position of the latch.

In accordance with another aspect of the invention, the blocking member having an arcuate surface at a leading end of the slot for guiding the abutment in to and out of the slot.

In accordance with another aspect of the invention, a spring is provided for biasing the blocking member in a rotational direction opposite to a rotational direction pertaining to the bias of the ratchet.

In accordance with another aspect of the invention, a latch for a vehicle hood for retaining a longitudinal axis of a body of a striker positioned along an X axis extending from a front to a rear of a vehicle is provided, with a Y axis extending between sides of the vehicle, and a Z axis representing vertical travel into and out of an XY plane. The latch includes a housing for mounting on a side area of the vehicle for positioning rotation of at least some of the latch components on an XZ plane; a ratchet of the latch components is mounted on the housing for pivoting about a first pivot axis; a pawl of the latch components is mounted on the housing for pivoting about a second pivot axis and biased into engagement with the ratchet; and a safety catch member is mounted on the housing about a third pivot axis and is configured for engagement with the striker when released from the ratchet.

In accordance with another aspect of the invention, a link lever can be coupled to the pawl for pivoting about a pivot axis for interacting with a safety catch member, wherein the safety catch member can be configured for engagement with an abutment surface of the link lever.

In accordance with another aspect of the invention, a latch includes a housing; a ratchet mounted on the housing for pivoting about a first pivot axis and having a ratchet flattened portion extending between a slot and a bottom surface spaced from the slot; a pawl mounted on the housing for pivoting about a second pivot axis and biased into engagement with the ratchet; and a safety catch member mounted on the housing for pivoting about a third pivot axis and having a flattened portion extending between a nose at a proximate end of the safety catch member and an arm connecting a proximate end of the safety catch member to the pivot axis, wherein the flattened portion facilitates contact of the ratchet by the striker while accounting for positioning tolerances of the striker along the flattened portion to force the ratchet toward a closed latch position and wherein the flattened portion facilitates contact of the safety catch member by the striker when the striker exits the slot of the ratchet placing the latch in an open position.

In accordance with another aspect of the invention, a method of constructing a vehicle hood latch is provided. The method includes providing a housing; mounting a ratchet on the housing for pivoting about a first pivot axis; mounting a pawl on the housing for pivoting about a second pivot axis between a first position in biased locked engagement with the ratchet and a second position out of locked engagement with the ratchet; mounting a pawl lever on the housing for pivoting about a third pivot axis and configuring the pawl lever to engage the pawl and rotate the pawl about the second pivot axis from the first position to the second position during a first actuation of a first actuator linkage; mounting a double pull lever on the pawl lever for pivoting about a fourth pivot axis, the double pull lever having an abutment surface; and mounting a safety catch member on the housing for pivoting movement about a fifth pivot axis and configuring the safety catch member for selective engagement with the abutment surface to pivot the safety catch member from a locked first position to an unlocked second position during a second actuation of the first actuator linkage.

In accordance with another aspect of the invention, the method further includes operably attaching the first actuator linkage to the pawl lever.

In accordance with another aspect of the invention, the method further includes operably attaching a second actuator linkage to the pawl.

In accordance with another aspect of the invention, the method further includes attaching the second actuator linkage to an actuator for automated actuation of the second actuation linkage independent of said first linkage.

In accordance with another aspect of the invention, a method of constructing a vehicle hood latch is provided. The method includes providing a housing; mounting a ratchet on the housing for pivoting about a first pivot axis; mounting a pawl on the housing for pivoting about a second pivot axis between a first position in biased locked engagement with the ratchet and a second position out of locked engagement with the ratchet; mounting a pawl lever on the housing for pivoting about a third pivot axis and configuring the pawl lever to engage the pawl and rotate the pawl about the second pivot axis from the first position to the second position during a first actuation of a first actuator linkage; coupling a first linkage to the pawl lever for disengaging the pawl from the ratchet during a first actuation of the first linkage; and coupling a second linkage to the pawl for disengaging the pawl from the ratchet through a first actuation of the second linkage independent of the first linkage.

In accordance with another aspect of the invention, the method further includes mounting a double pull lever on the pawl lever and mounting a safety catch member on the housing, with the double pull lever being pivotal about a fourth pivot axis in response to a second actuation of the first linkage to bring the double pull lever into operable engagement with the safety catch member to pivot the safety catch member about a fifth pivot axis.

In accordance with another aspect of the invention, the method further includes configuring the first linkage to be manually actuatable.

In accordance with another aspect of the invention, the method further includes configuring the second linkage for automated actuation.

BRIEF DESCRIPTION OF THE DRAWINGS

The foregoing and other aspects will now be described by way of example only with reference to the attached drawings, in which:

FIG. 2K is a perspective view of FIG. 2J with a housing operably attached to the blocking member and the safety catch member;

FIG. 2L is an opposite side, flipped perspective view of FIG. 2K;

DETAILED DESCRIPTION OF THE INVENTION

Figure 1A:
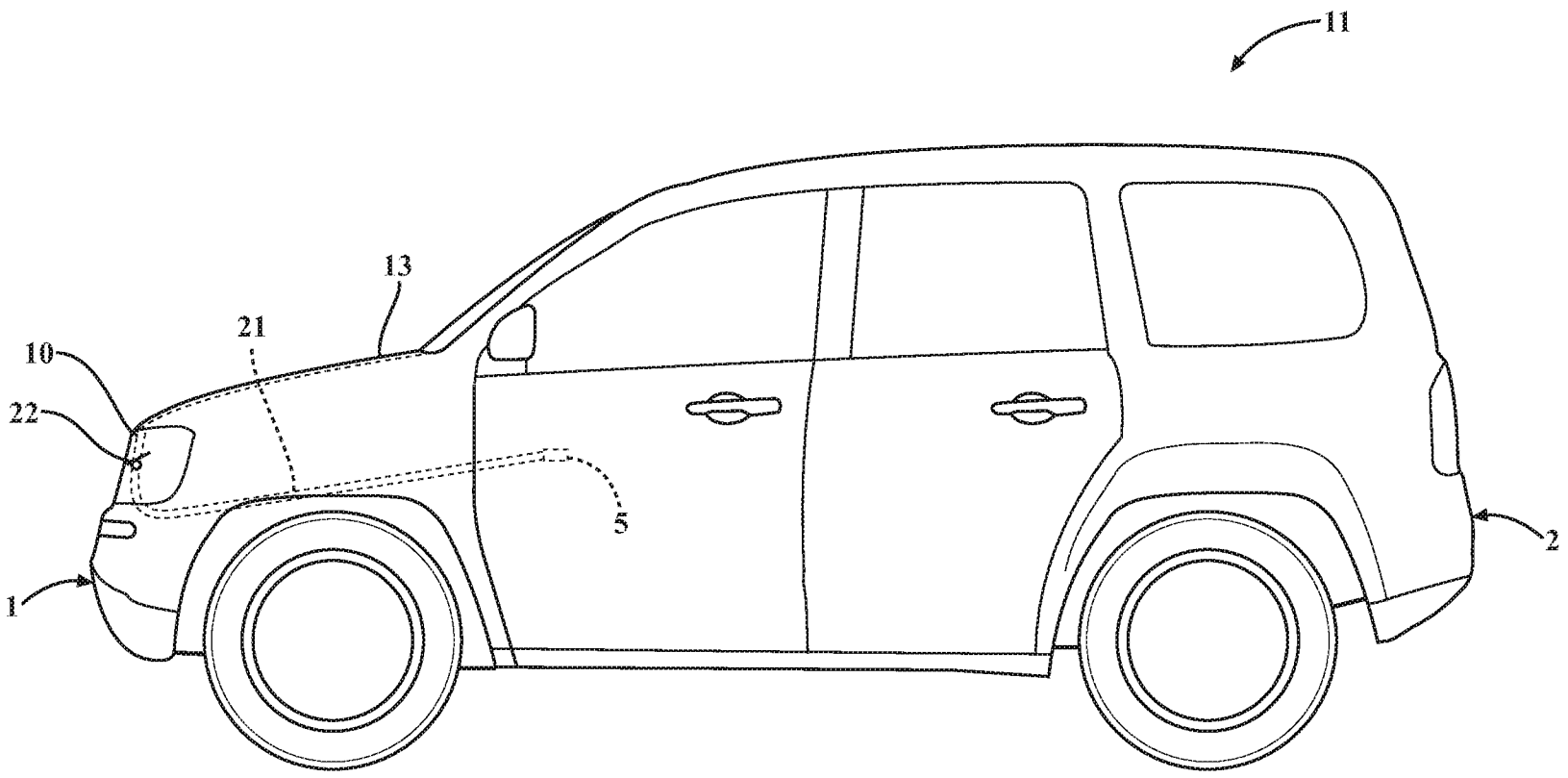
FIG. 1A is a side view of a vehicle.
Figure 1B:
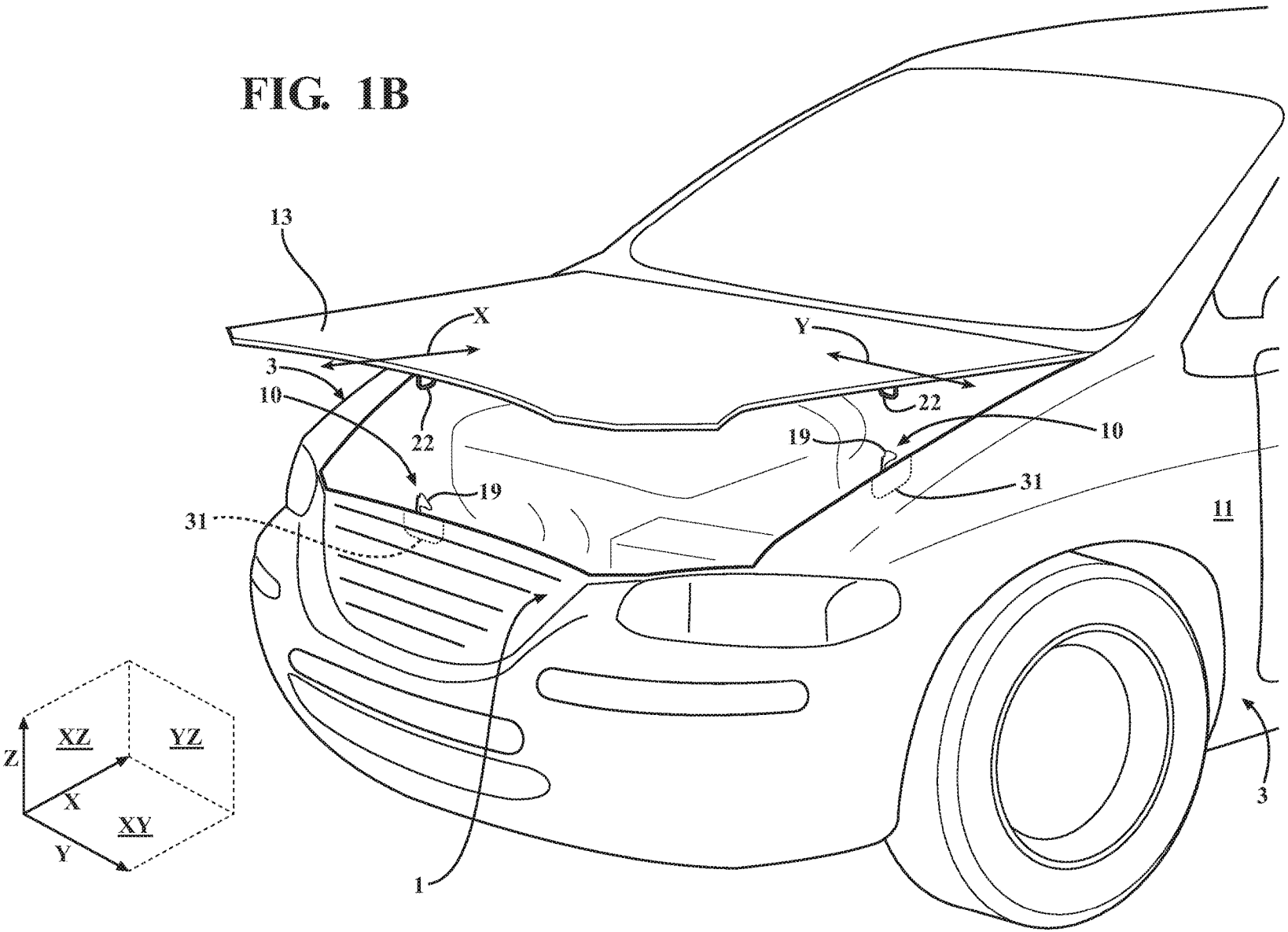
FIG. 1B is a partial perspective view of the vehicle of FIG. 1A.

Reference is made to FIG. 1A, which shows a vehicle 11 that has a hood 13, on which there is at least one striker 22. The striker 22 is capturable and releasable lockable to a vehicle hood latch, referred to hereafter as latch 10, that is mounted on the body of the vehicle 11. Referring to FIG. 1B, in one embodiment the hood latch 10 can be positioned on a frontal area or front 1 of the vehicle along a YZ plane, such that a longitudinal axis of a body of the striker 22 is positioned along an X-axis extending from the front 1 to a rear 2 of the vehicle 11, with a Y-axis extending between opposite sides 3 of the vehicle 11, and a Z-axis representing vertical travel into and out of an XY plane, such that the Z-axis extends transversely to the XY plane. In accordance with one aspect of the invention, accommodation of manufacturing tolerances for the striker 22 in the X direction can be accommodated for by simply adjusting the length of the striker 22 along the X-axis.

Further, in alternative embodiments, the vehicle 11 can have one or more hood latches 10 positioned on the XZ plane along both or either side 3 of the vehicle 11. In this embodiment, compensation for manufacturing tolerances of the striker 22 along the X direction depends on both a ratchet 12 and a safety catch member 19 (see FIG. 3B, for example). An advantage with this design is that the safety catch member 19 integrated into the hood latch 10 is located along the side(s) 3, and as such, is desirably located due to potential pedestrian injures when coming into abrupt contact with the safety catch member 19 during collisions. When the hood latch 10 is positioned on the side(s) 3 of the vehicle 11 on the XZ plane, such that a longitudinal axis of a body of the striker 22 is positioned along the Y-axis extending between the sides 3 of the vehicle 11, accommodation of manufacturing tolerances of the striker 22 in the X direction can be facilitated by configuring extended contact surfaces or portions 45, 47 (FIGS. 5A and 5B) of both the ratchet 12 and the safety catch member 19 independently of the length of the striker 22 along the Y-axis, i.e. the length dimension of the body of the striker 22 along the longitudinal axis in the Y direction.

In accordance with one aspect of the invention, as shown in FIGS. 2K and 2L, the hood latch 10 includes a mounting member, sometime referred to as frame plate and referred to hereafter as housing 20, for mounting on a frame member of the vehicle 11, such as one or both sides 3 of the vehicle 11 for rotation of latch components along the XZ plane, with a longitudinal axis of a body of a striker 22 extending along the Y axis. The hood latch 10 further includes a ratchet 12 mounted on the housing 20 for pivoting about a first pivot axis 1*a*, a pawl 14 mounted on the housing 20 for pivoting about a second pivot axis 1*b* and biased into engagement with the ratchet 12, a link lever, also referred to as a release lever or double pull lever 17, operably coupled to the pawl 14 for pivoting about a third pivot axis 4*c* and for interacting with a safety catch member 19, wherein the safety catch member 19 is operably mounted on the housing 20 about a fourth pivot axis 1*e* and configured, via a protrusion, also referred to as travel block pin or pin 3*e*, extending laterally outwardly therefrom, for selective engagement with an abutment surface, also referred to as receptacle or notch 5*c*, of the double pull lever 17. As such, a configuration of hood latch 10 can facilitate opening from inside of the vehicle with a double pull actuation of the double pull ever 17 via an actuator handle 5 inside the vehicle 11 (further described below), while also providing a safety catch function via the safety catch member 19 integrated on the housing 20 of the latch 10.

Figure 2A:
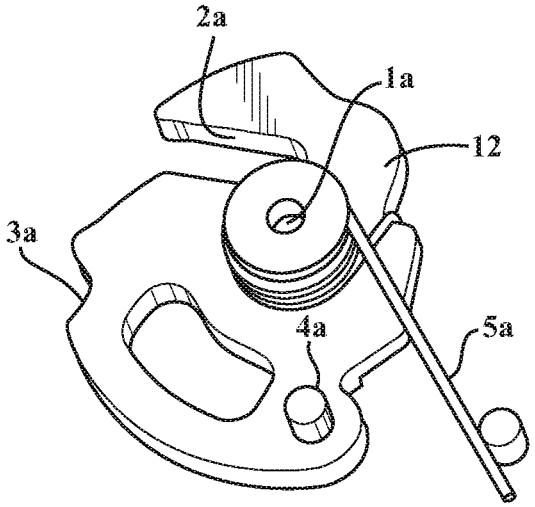
FIG. 2A is a perspective view of a ratchet of a latch of a hood of the vehicle of FIGS. 1A-1B.
Figure 2B:
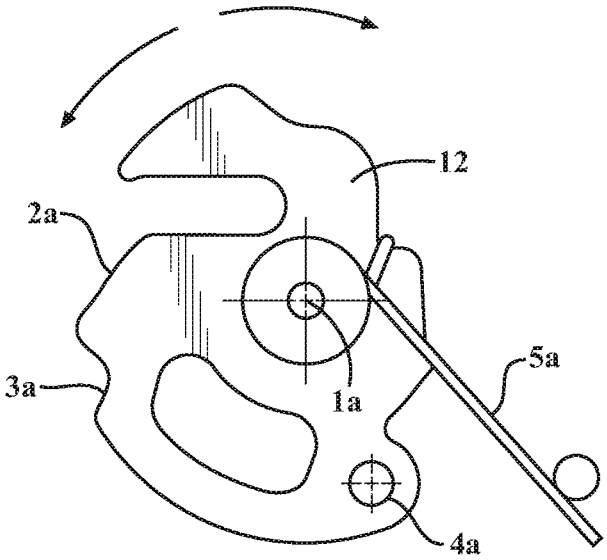
FIG. 2B is a plan view of FIG. 2A.

Referring to FIGS. 2A and 2B, components shown of the latch 10 include the ratchet 12 and pivot axis 1*a* thereof, the ratchet 12 and striker retaining area 2*a* thereof, a closing notch 3*a* of the ratchet 12 for coupling with the pawl 14 (FIG. 2B), an extra travel link rivet, also referred to has abutment or pin 4*a* extending laterally outwardly from a generally planar body of the ratchet 12, and release spring 5*a* for biasing the ratchet 12 toward a released position, which in turn allows the striker 22 to become free of the retaining area 2*a*.

Figure 2C:
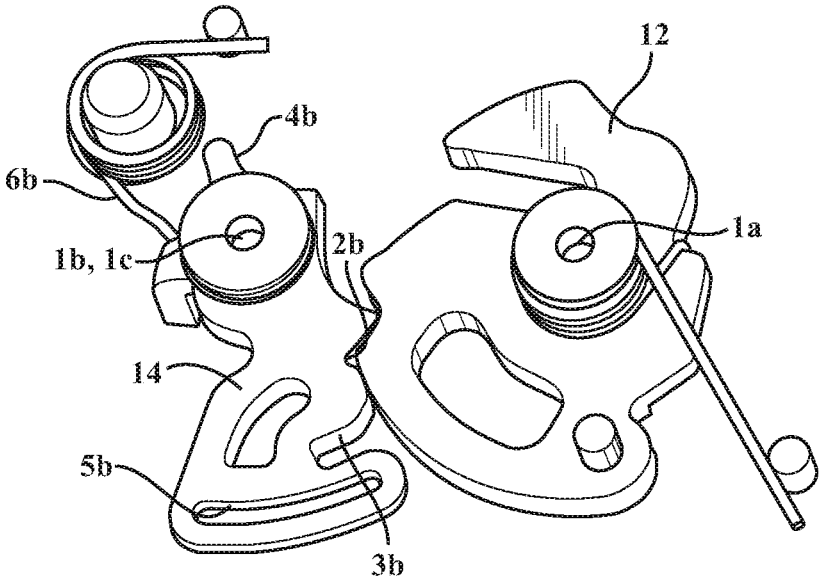
FIG. 2C is a perspective view of the ratchet of FIG. 2A shown in releasably locked engagement with a pawl of the latch.
Figure 2D:
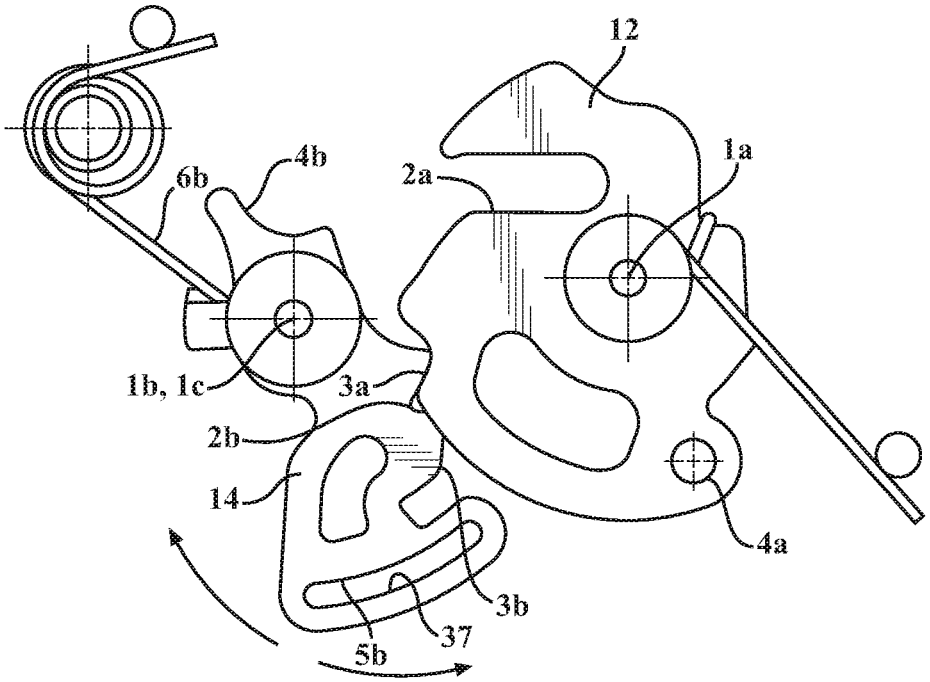
FIG. 2D is a plan view of FIG. 2C.

Referring to FIGS. 2C and 2D, further components shown of the latch 10 include the pawl 14 and pivot axis 1*b* thereof, wherein the pawl 14 and ratchet retaining member, also referred to as ratchet retaining protrusion or area 2*b* thereof, are configured for operable coupling with the ratchet 12. The pawl 14 includes a pawl lever contact surface, notch or profile surface 3*b*, for engagement with a pawl lever 15 (FIGS. 2E and 2F), wherein the pawl lever 15 has a command profile extending transversely from a main, generally planar body of the pawl lever, also referred to as tang or tab 2*c* configured for receipt in the profile surface 3*b* of the pawl 14. The pawl 14 also includes a double pull lever contact profile, also referred to as extension, protrusion or arm 4*b*, for operable coupling with a double pull lever 17. The pawl 14 further includes a ratchet retaining area or protrusion 2*b* for operable engagement and disengagement with a closing recess or notch 3*a* in the ratchet 12 and a pedestrian link area slot or region 5*b* for operable connection with an actuator member 33, such as a cable, by way of example and without limitation, which in turn is configured in operable connection with an actuator device 31, discussed further below. A spring member 6*b* is provided for operable attachment to the pawl 14 and the housing 20 for biasing the pawl 14 toward a first closed, locked position which coincides with a closed position of the latch 10, and into restraining contact with the ratchet 12. Rotation of the pawl 14 about the axis 1*b* in response to actuation thereof via the actuator member 33 and in response to bias of the spring member 6*b* provides for disengagement and engagement of the ratchet retaining protrusion 2*b* with the closing notch 3*a*, thus resulting in rotation of the ratchet 12 about pivot axis 1*a*.

Figure 2E:
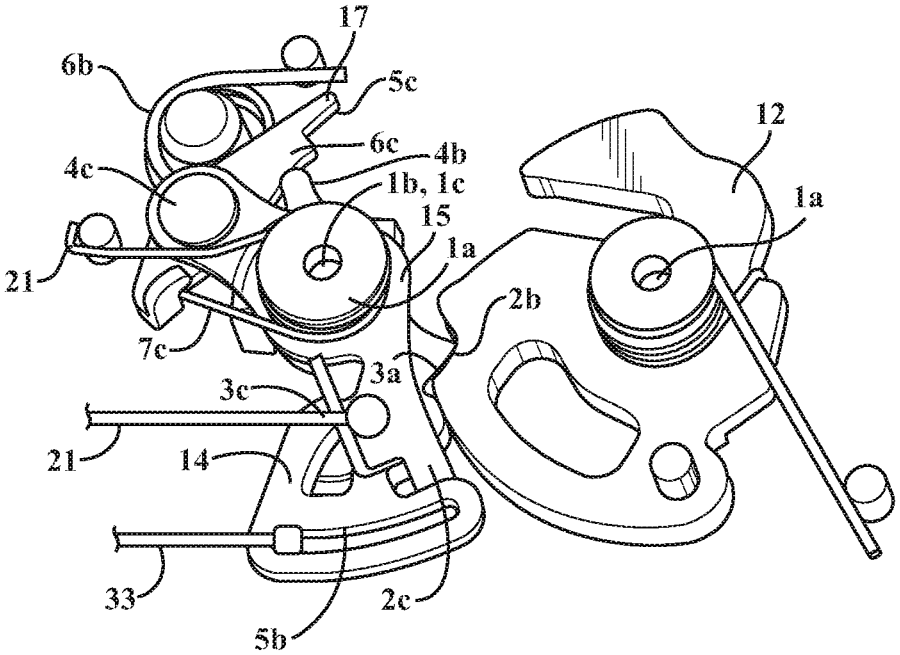
FIG. 2E is a perspective view similar to FIG. 2C with a latch lever pivotally attached to the pawl and a double pull lever pivotally attached to the pawl lever.
Figure 2F:
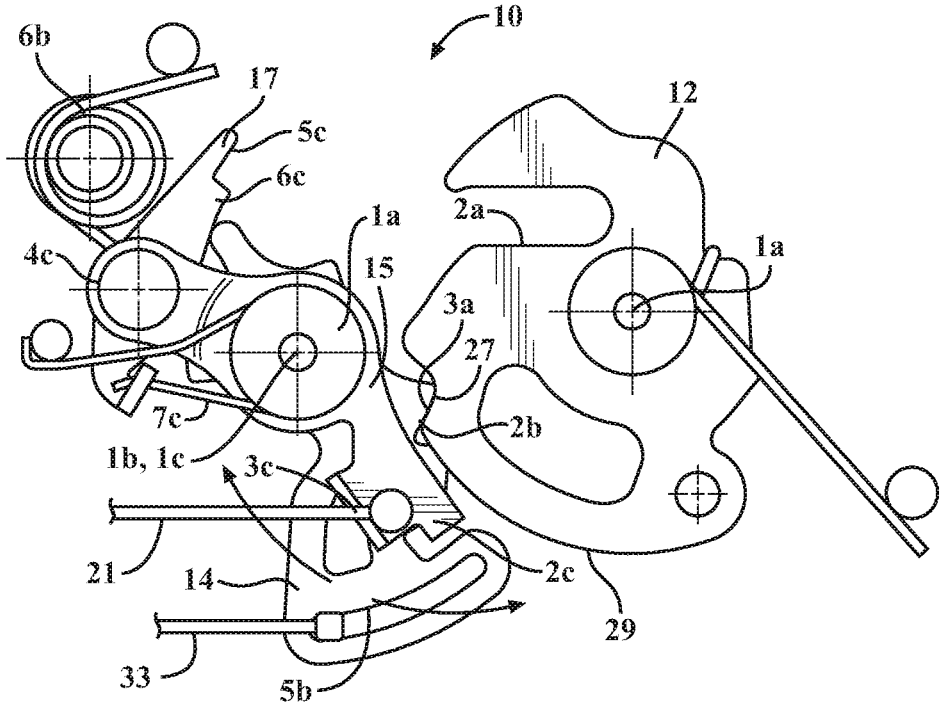
FIG. 2F is a plan view of FIG. 2E.

Referring to FIGS. 2E and 2F, further components/features shown of the latch 10 include a fixed pivot axis 1*c* for the pawl lever 15, corresponding with the pawl pivot axis 1*b*, an internal handle actuator link connection feature or area 3*c* on the pawl lever 15 for operable connection with a first actuator linkage, referred to hereafter as first linkage, passive linkage or linkage 21 (e.g. cable), for causing the pawl lever 15 to rotate about the pivot axis 1*c* upon being actuated, such as from inside the vehicle via the handle 5. Further features include the double pull lever axis 4*c* about which the double pull lever 17 rotates, safety catch command profile or notch 5*c* within the double pull lever 17 for engaging the double pull link pin 3*e* (FIG. 2J) of the safety catch member 19, a pawl contact profile or surface 6*c* of the double pull lever 17 for sliding abutment with the double pull lever contact arm 4*b* of the pawl 14, a spring member 7*c* operable to bias the pawl lever 15 toward a closing direction and for biasing the double pull lever 17 in a clockwise direction. Accordingly, pulling actuation movement of the linkage 21 causes rotation of both the pawl 14 and the pawl lever 15 about respective pivot axes 1*b*, 1*c*, thus causing disengagement between the ratchet 12 and the pawl 14 by removing the retaining protrusion 2*b* of the pawl 14 from the closing notch 3*a* of the ratchet 12, as well as causing the pawl contact surface 6*c* of the double pull lever 17 to engage the double pull link pin 3*e* of the ratchet 12.

Figure 2G:
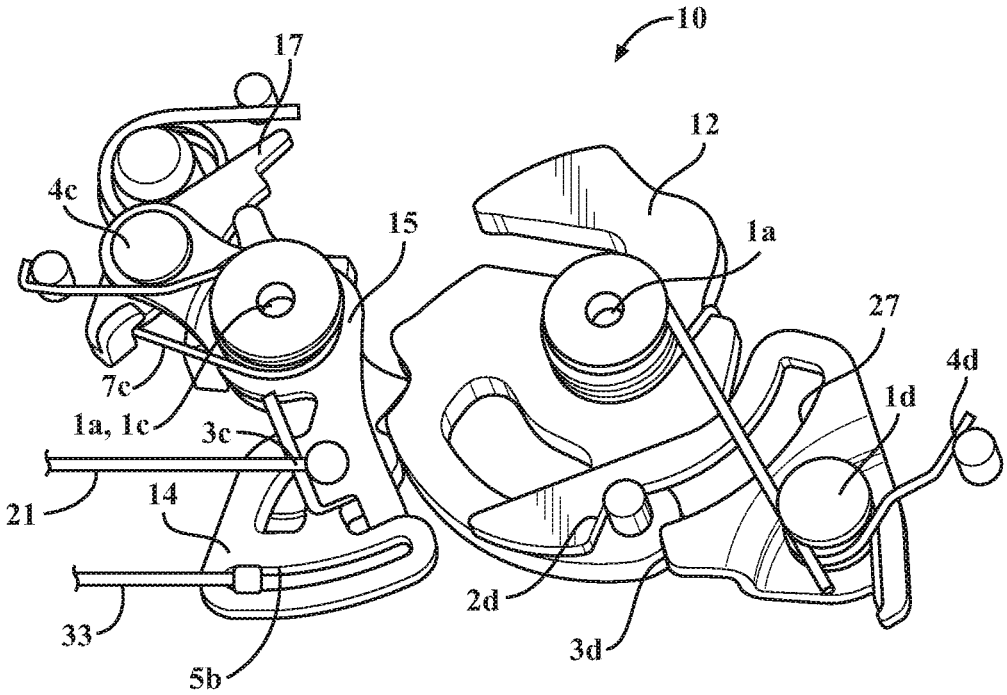
FIG. 2G is a perspective view similar to FIG. 2E with a blocking member operably engaged with a travel link pin of the ratchet.
Figure 2H:
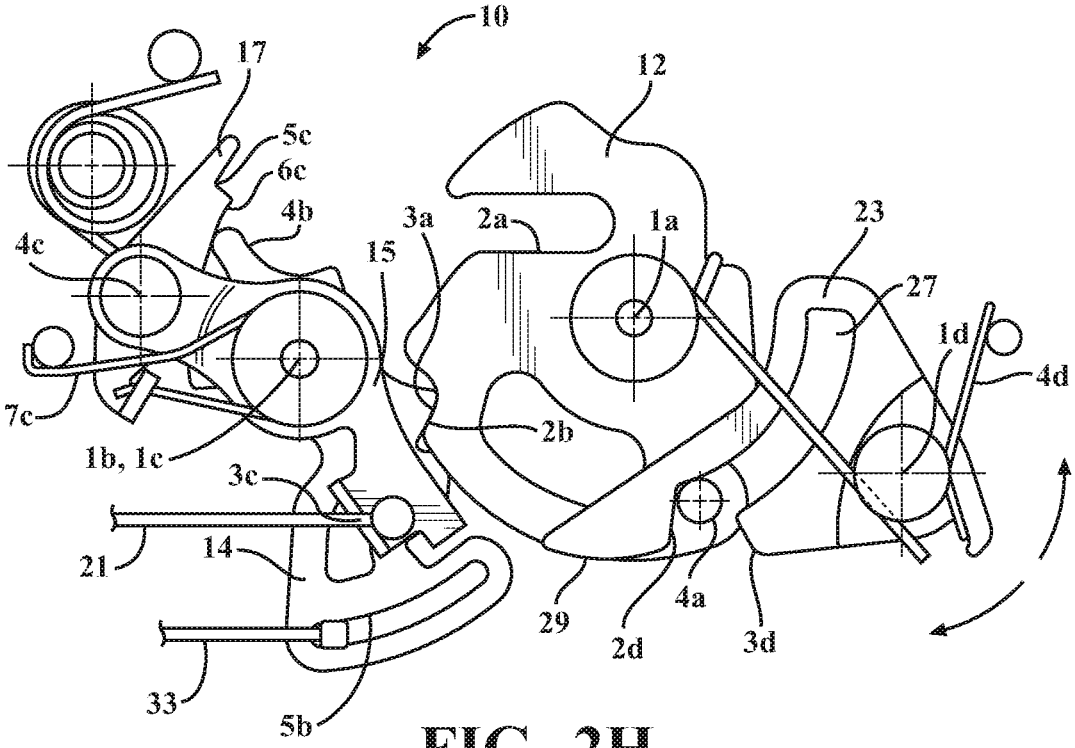
FIG. 2H is a plan view of FIG. 2G.

Referring to FIGS. 2G and 2H, further components/features shown of the latch 10 include a pivot axis 1*d* for a blocking member 23, a ratchet pin command profile, also referred to as camming surface or surface 2*d* on the blocking member 23 configured for operable engagement with a ratchet pin 4*a* of the ratchet 12, an extra travel block profile, abutment or surface 3*d* for operably confronting and contacting the ratchet pin 4*a* when restricting extra travel of the ratchet pin 4*a* is desired, such as during closing of the latch 10, and a spring member 4*d* for biasing the blocking member 23 toward a closed position into engagement with the ratchet 12. With the above components/features, the latch 10 prevents the striker 22 from unwanted over travel, such as while closing the hood 13, and also allows for desired striker 22 over travel, such as during a crash, e.g. the hood 13 is impacted by a pedestrian.

Figure 2I:
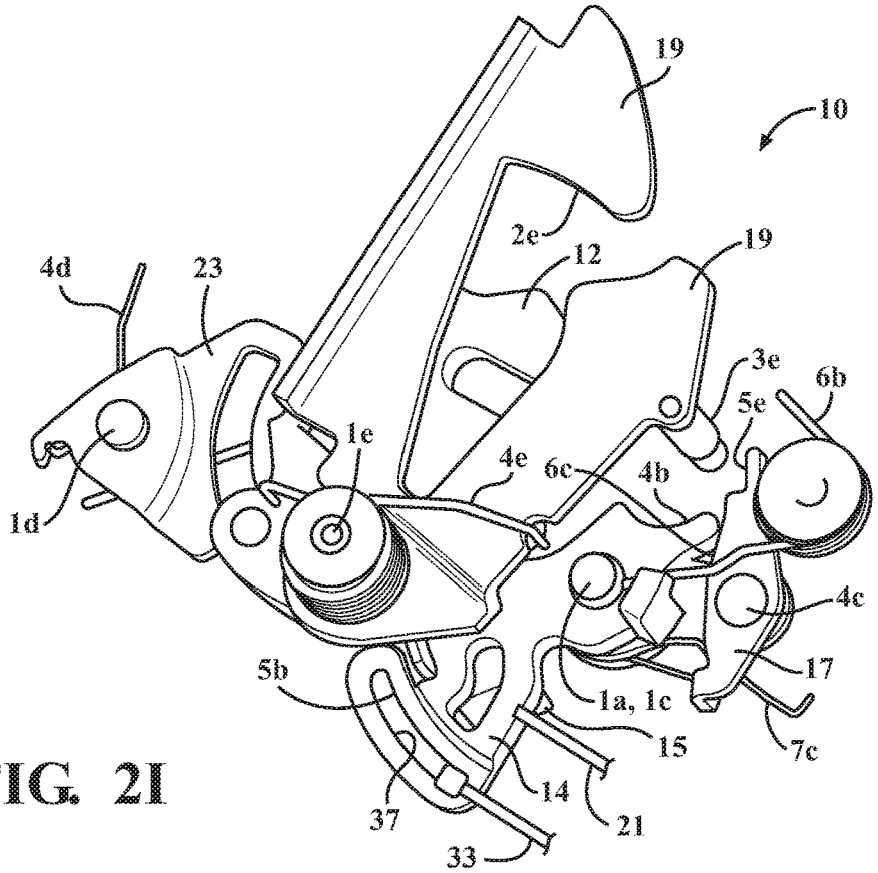
FIG. 2I is a perspective view similar to FIG. 2G with a safety catch member shown in a locked, restraining position.
Figure 2J:
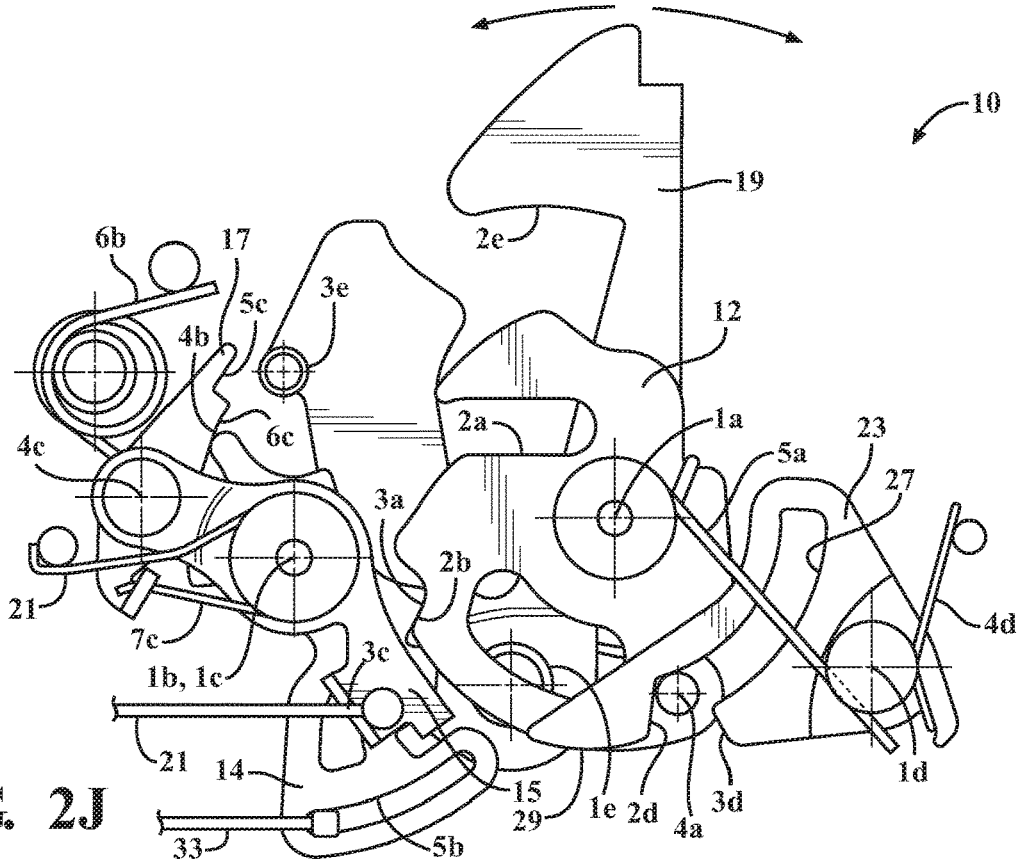
FIG. 2J is an opposite side, flipped plan view of FIG. 2I.

Referring to FIGS. 2I and 2J, further components/features shown of the latch 10 include the safety catch member 19 provided as a separate member to the ratchet 12 and rotatable about a different axis 1*e* spaced from the pivot axis 1*a* of the ratchet 12, a safety catch command profile or surface 2*e* of the safety catch member 19 for selectively engaging and obstructing the striker 22 when the striker 22 is initially released from the striker retaining area 2*a* of the ratchet 12, an extra travel block profile or surface or pin 3*e* extending outwardly from the safety catch member 19 for operable engagement with the safety catch command profile or notch 5*c* of the double pull lever 17, and a spring member 4*e* for biasing the safety catch member 19 for rotation towards a counterclockwise closed direction. In FIGS. 2K and 2L, the housing 20 for supporting the components/features of the latch 10 discussed above is shown, wherein it is to be recognized that the housing 20 can provide attachment points for at least some of the aforementioned spring members, as shown, and can provide attachments of pins/axles which provide the pivot axes 1*a*, 1*b*, 1*c*, 1*d*, 1*e*, by way of example and without limitation. It will be readily recognized by those skilled in the hood latch art that the housing 20 also provides for operable connection of the latch 10 to the body of the vehicle 11 via any suitable fastening mechanism.

In according with a further aspect of the invention, the latch 10 can include a housing 20, a ratchet 12 operably mounted on the housing 20 for pivoting about the first pivot axis 1*a*, a pawl 14 mounted on the housing 20 for pivoting about the second pivot axis 1*b* and biased into engagement with the ratchet 12, the pawl lever 15 mounted on the housing 20 for pivoting about the third pivot axis 1*c* and for engaging the pawl 14 to rotate the pawl 14 about the second pivot axis 1*b*, and a double pull lever 17 operably mounted on the pawl lever 15 for pivoting about the fourth pivot axis 4*c* and for interacting with a safety catch member 19, wherein the third pivot axis 1*c* and the fourth pivot axis 4*c* are spaced apart from one another along a body of the pawl lever 15. The latch 10 can have a linkage 21 operably connected to the pawl lever 15 for acting on the pawl lever 15 to selectively disengage the pawl 14 from the ratchet 12 through a selective first actuation of the linkage 21. After the initial first actuation, the safety catch member 19 still acts to obstruct the striker 22 and maintain the latch 10 in a secondary closed position, such the hood 13 remains closed.

The latch 10 can have the linkage 21 configured to act a second time during a second actuation on the pawl lever 15 through a selective second actuation of the linkage 21, after the first actuation, to drive the double pull member 17 about the second pivot axis 1*c* to drive rotation of the safety catch member 19 about the fifth pivot axis 1*e* of the housing 20 and effectively move the safety catch member 19 out from obstruction with the striker 22, thereby allowing the hood 13, and striker 22 attached thereto, to be raised to a fully open position. The latch 10 can have the pivoting of the pawl lever 15 about the third axis 1*c* be independent of the pivoting of the double pull lever 17 about the fourth axis 4*c*.

The latch 10 can have the second pivot axis 1*b* and the third pivot axis 1*c* as the same axis, thereby being coaxial. The safety catch member 19 can be mounted on the housing 20 about the fifth pivot axis 1*e* and configured (e.g. via pin 3*e*) for selective operable engagement with the abutment surface 5*c* of the double pull lever 17 during a second actuation operation. The latch 10 can have the protruding double pull contact arm 4*b* extending from a main body of the pawl 14 configured to selectively inhibit engagement of the abutment surface 5*c* with the safety catch member 19, as desired. The latch 10 can have the biasing spring member 7*c* configured to bias both the pawl lever 15 and the double pull lever 17 for operable movement relative to one another.

In accordance with a further aspect of the invention, the latch 10 can have a housing 20, a ratchet 12 mounted on the housing 20 for pivoting about the first pivot axis 1*a*, a pawl 14 mounted on the housing 20 for pivoting about the second pivot axis 1*b* between a first position in locked engagement with the ratchet 12 and a second position out of locked engagement with the ratchet 12, wherein the pawl 14 is biased into the first position into selectively locked engagement with the ratchet 12, and a blocking member 23 mounted on the housing 20 for pivoting about a third pivot axis 1*d* and biased into engagement with the ratchet 12, the second pivot axis 1*b* and the third pivot axis 1*d* being spaced apart from one another, the blocking member 23 having a command surface 2*d* for interacting in operable engagement with the abutment 4*a* of the ratchet 12, a blocking surface 3*d* configured to confront and inhibit pivoting and over-travel of the ratchet 12 when in contact with the abutment 4*a*, and an elongate, arcuate slot 27 extending along the body of the blocking member 23 for receiving the abutment 4*a* when the ratchet 12 pivots past a closed position of the latch 10. The blocking member 23 can have an arcuate surface 29 originating at a leading end of the slot 27 to facilitate guiding the abutment 4*a* smoothly into and out of the slot 27. The latch 10 can include a spring member 4*d* for biasing the blocking member 23 in a rotational direction opposite to the biased rotational direction of the ratchet 12.

Figure 3A:
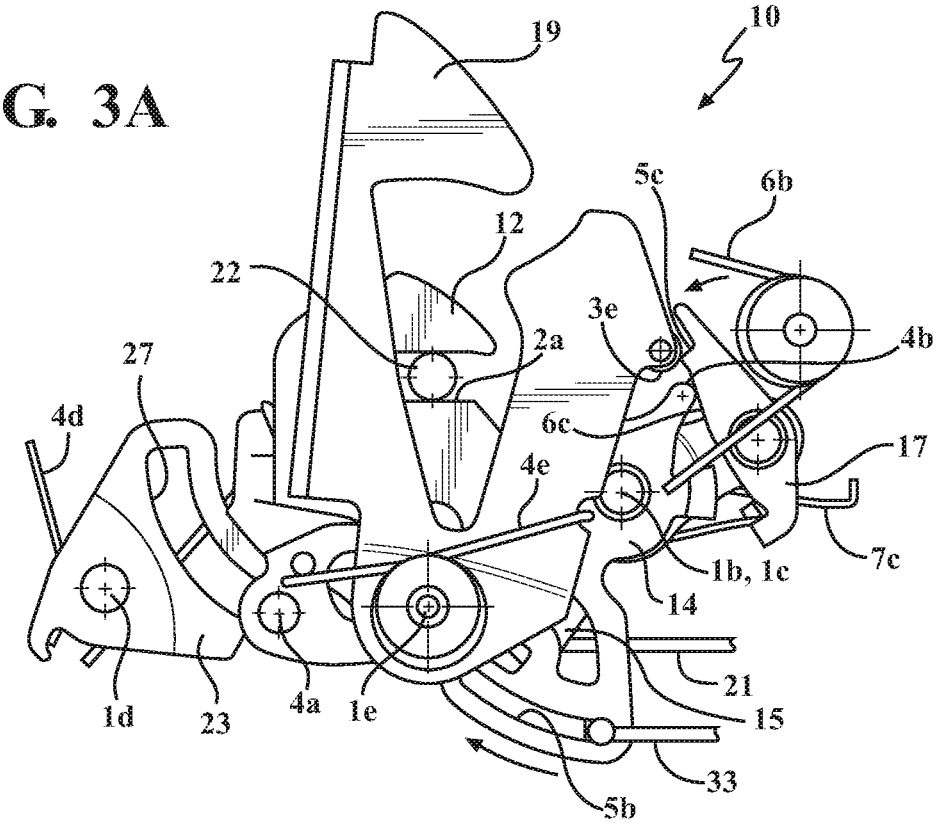
FIGS. 3A, 3C, 3E, 3G, 3I, 3K, 3M shown a progression of a double actuation of the latch of FIG. 1A from one side of the latch.
Figure 3B:
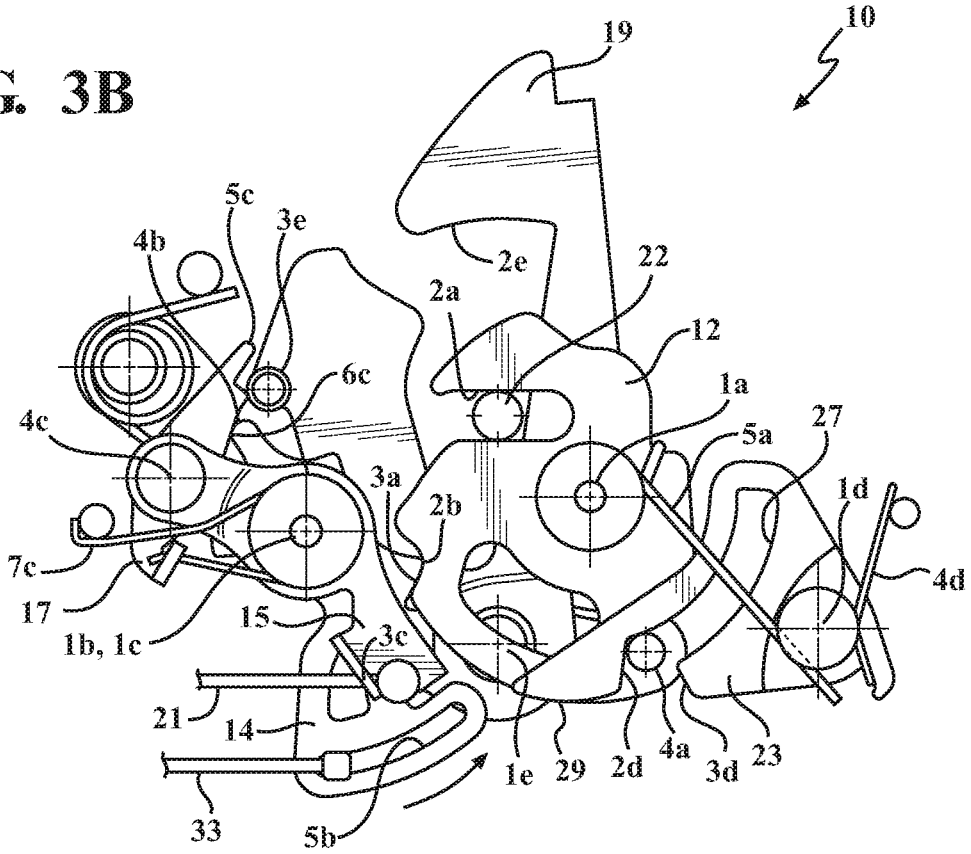
FIGS. 3B, 3D, 3F, 3H, 3J, 3L, 3N show a corresponding progression of the double action from an opposite of the latch.
Figure 3C:
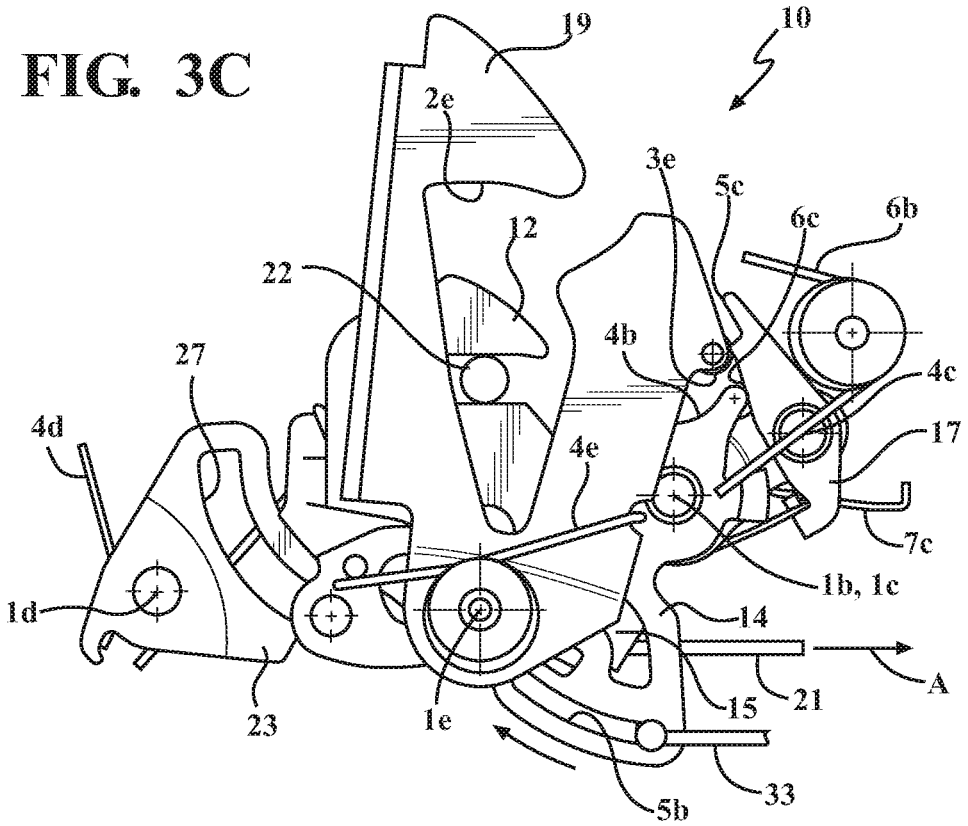
Figure 3D:
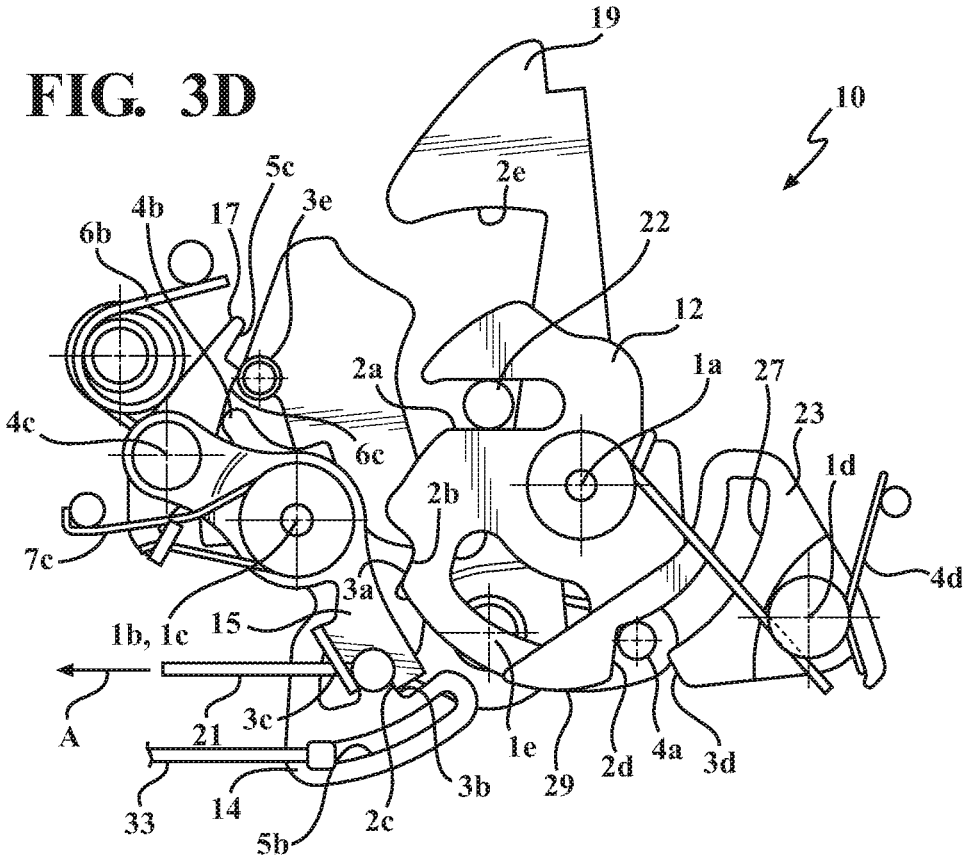

Referring to FIGS. 3A and 3B, the latch 10 is shown in a fully locked, closed position, also referred to as primary closed position, such that the pawl 14 is engaged with the ratchet 12, the striker 22 is seated in the striker retaining area 2*a*, the surfaces 3*a* and 2*b* are engaged, thus restraining and maintaining the ratchet 12 in the closed position, with the hood 13 being fully closed. It is noted that the travel block pin 3*e* may not be engaged with the abutment surface 5*c* in the closed position. Also, abutment 4*a* can be in contact with the ratchet pin command surface 2*d* and located, at least in part, within the slot 27 of the blocking member 23. Referring to FIGS. 3C and 3D, the linkage 21 is actuated along the direction of arrow A (e.g. manual pull of the handle 5 by a vehicle occupant, by way of example and without limitation) and the pawl lever 15 is pulled against the bias of spring member 7*c* and engages the pawl 14 by contact of pawl lever contact surface 3*b* with the pawl command profile or notch 2*c* by pivoting about axis 1*b*, 1*c*. Also, the double pull lever contact arm 4*b* of the pawl 14 engages with the pawl contact surface 6*c* of the double pull lever 17 in order to inhibit engagement between the safety catch command surface 5*c* of the double pull lever 17 and the travel block pin 3*e* of the safety catch member 19.

Figure 3E:
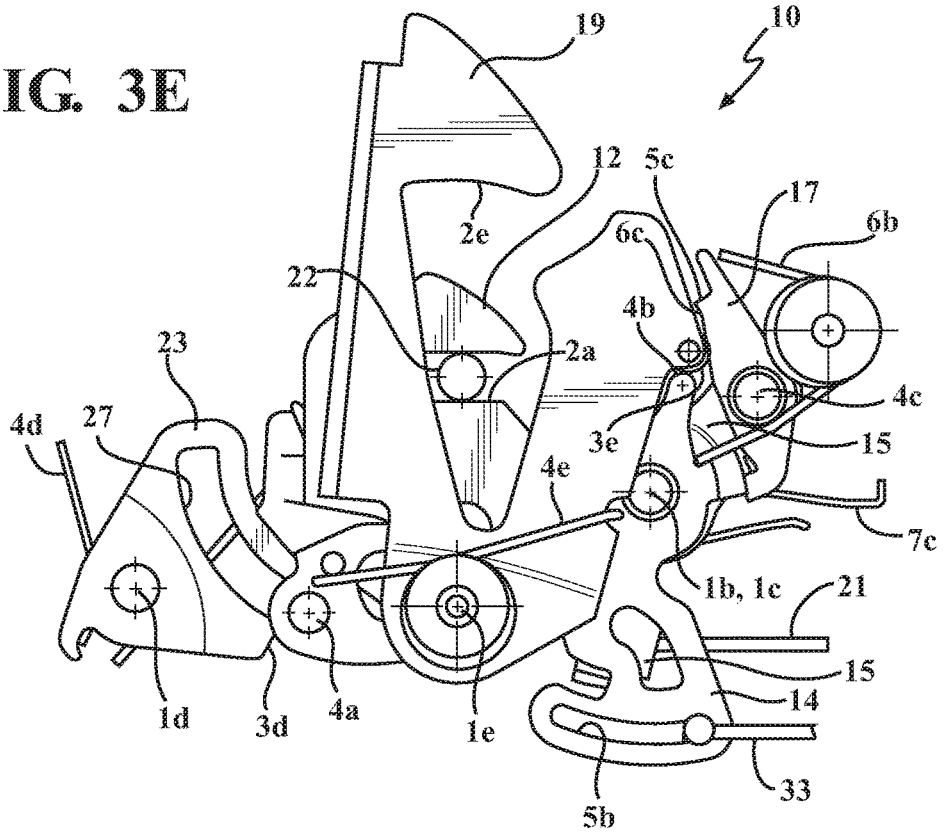
Figure 3F:
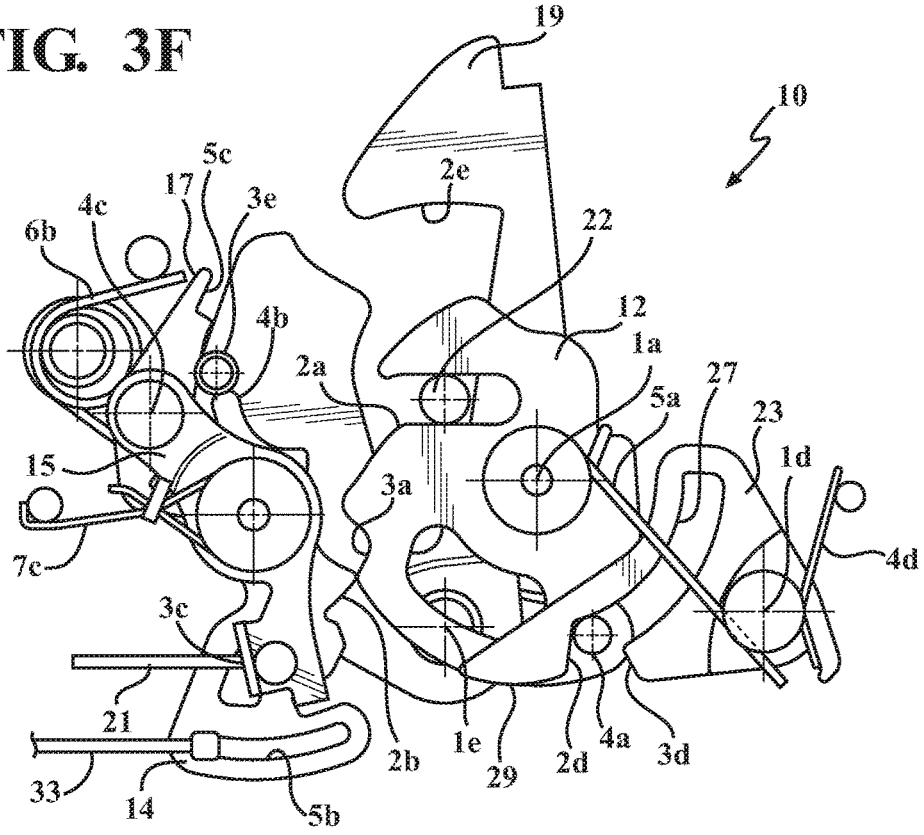

Referring to FIGS. 3E and 3F, continued pulling actuation of the linkage 21 along the direction of arrow A continues to pivot the pawl 14 about pivot axis 1*b* to cause disengagement of the pawl 14 from the ratchet 12 (i.e. disengagement of ratchet retaining protrusion 2*b* from the closing notch 3*a*). Noted is that the double pull lever 17 pivots about axis 4*c* and remains disengaged with travel block pin 3*e* (e.g. pawl contact surface 6*c* versus abutment surface 5*c* is in contact with the travel block pin 3*e*).

Figure 3G:
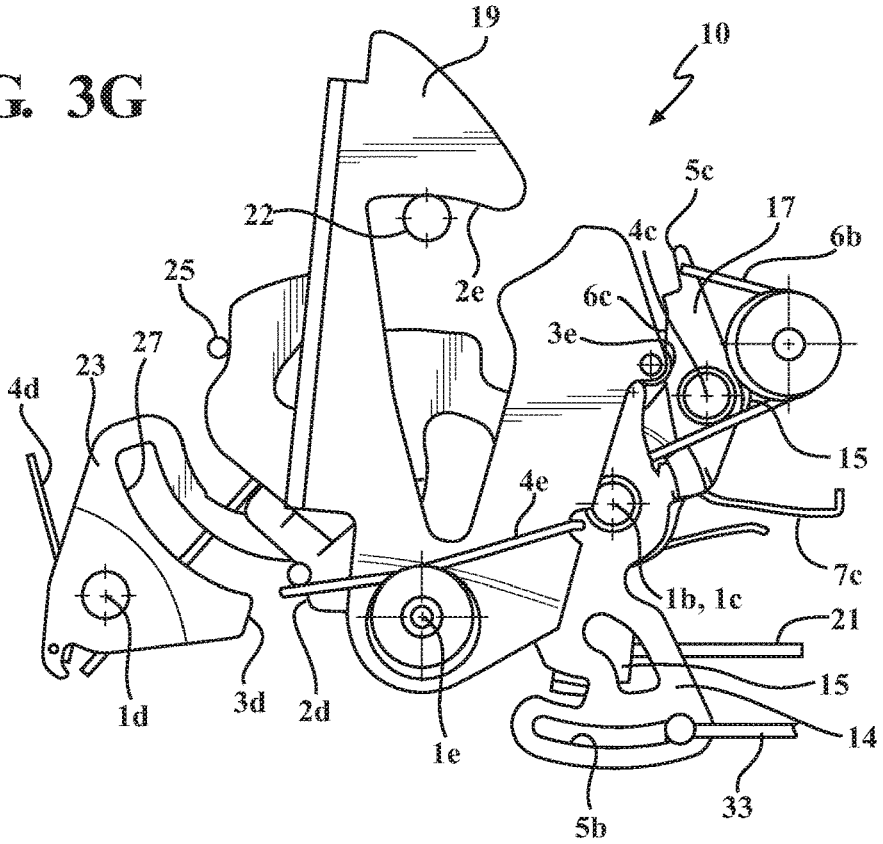
Figure 3H:
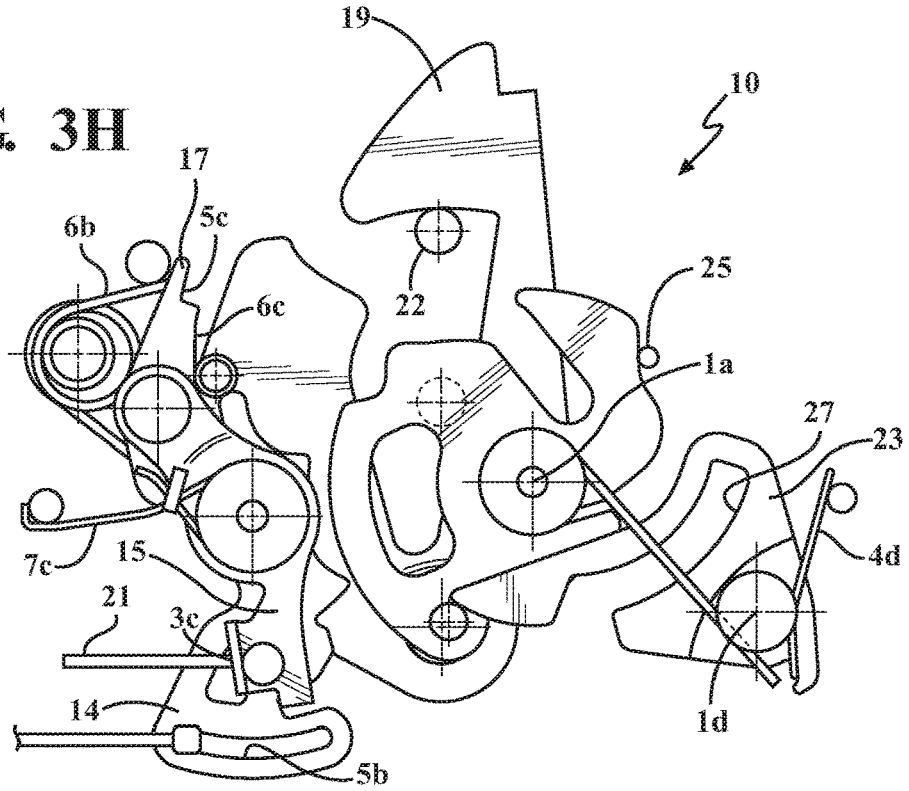

Referring to FIGS. 3G and 3H, once the ratchet retaining protrusion 2*b* and closing notch 3*a* disengage, the ratchet 12 suddenly and automatically rotates about pivot axis 1*a* under the bias of the ratchet biasing release spring 5*a* from the locked, closed position to an unlocked first open position and releases the striker 22 from the striker retaining area 2*a*, wherein the striker 22 is then obstructed, intercepted, blocked and engaged by the safety catch command profile, also referred to as striker retaining area 2*e* of the safety catch member 19. The ratchet 12 is restrained from further travel by a stop 25, shown in FIGS. 2K, 3G-3N, 4A-B, 4D, 5A-B, 6B-D, which can be formed by a bent portion or tab of the housing 20, as shown in FIGS. 2K, 4A-B, by way of example and without limitation, and the blocking member 23 is caused to rotate about pivot axis 1*d* via cammed engagement between ratchet pin command surface 2*d* and arcuate surface 29 of the blocking member 23 and ratchet pin 4*a*. Accordingly, abutment 4*a* moves automatically with rotation of the ratchet 12. In this released configuration, the latch 10 is now is a first open position, less than completely open and is selectively prevented from moving to a fully open state, also referred to as secondary or partially closed position, such that the striker 22 is released from the ratchet 12 but is still restricted and prevented from further travel along the Z-direction by the safety catch member 19, and thus, the striker 22 is not completely unlatched from the latch 10.

Figure 3I:
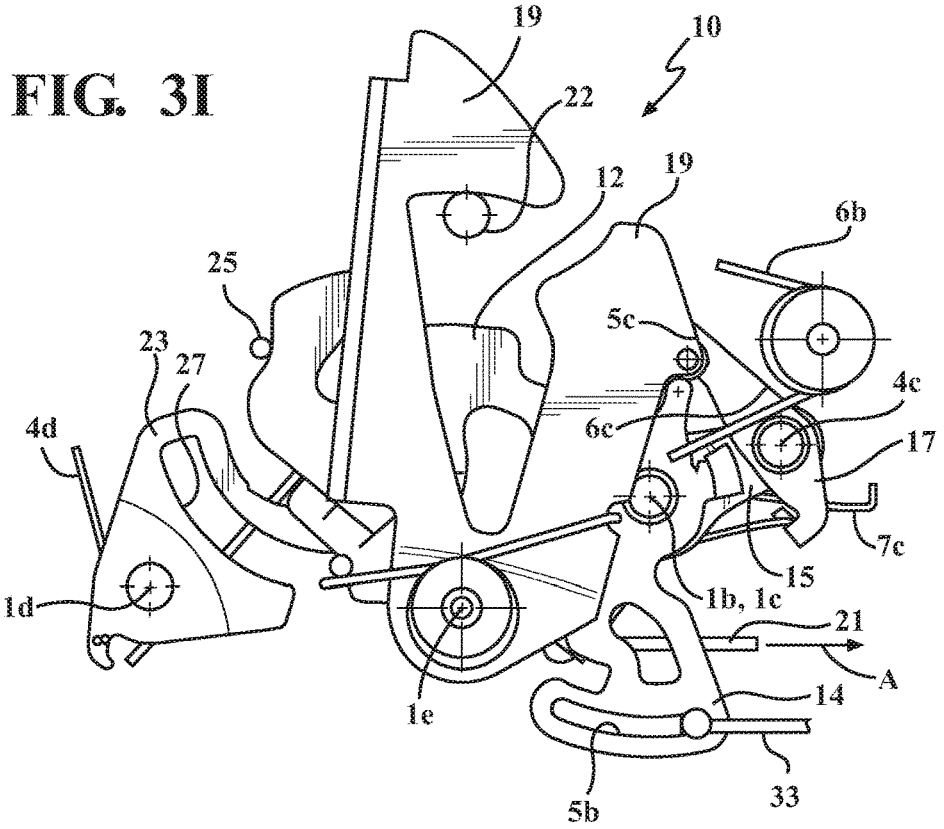
Figure 3J:
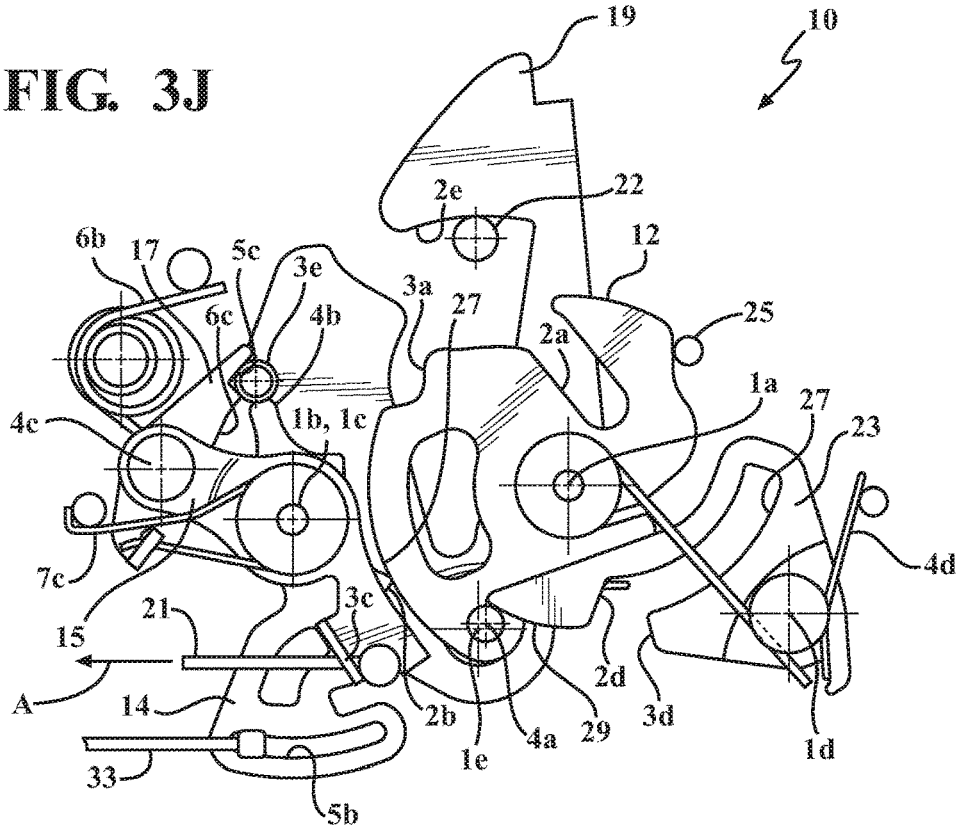
Figure 4A:
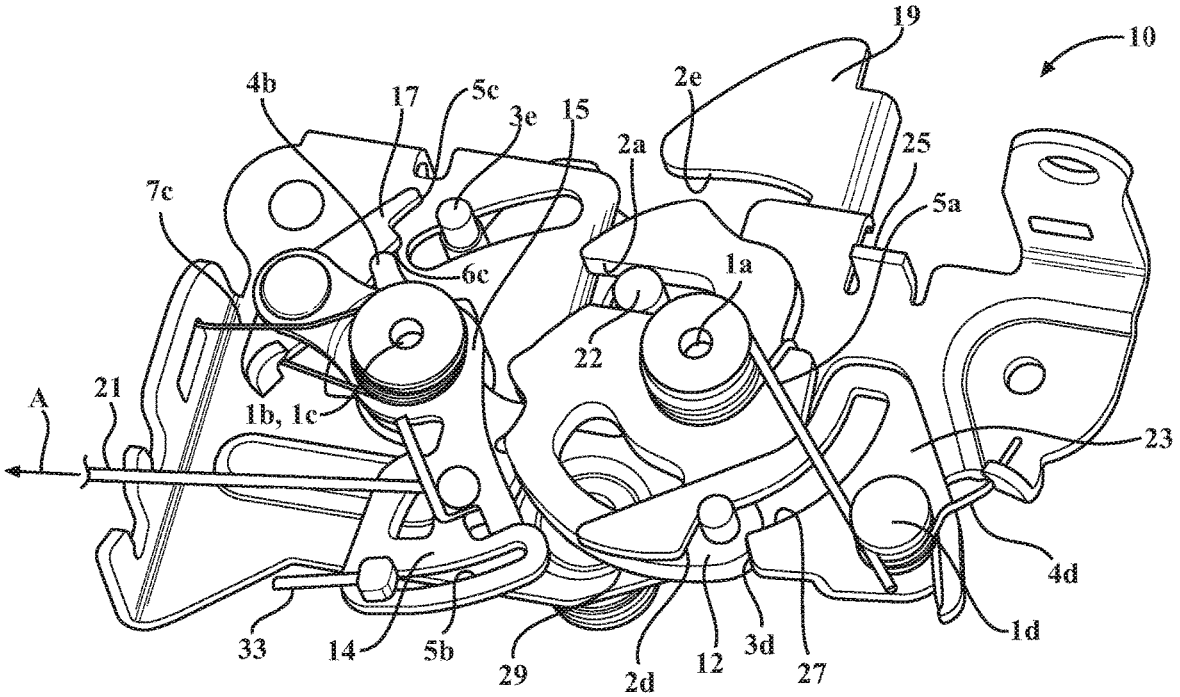
FIGS. 4A-4F show an example of the latch of FIG. 1A for different example modes of operation.
Figure 4B:
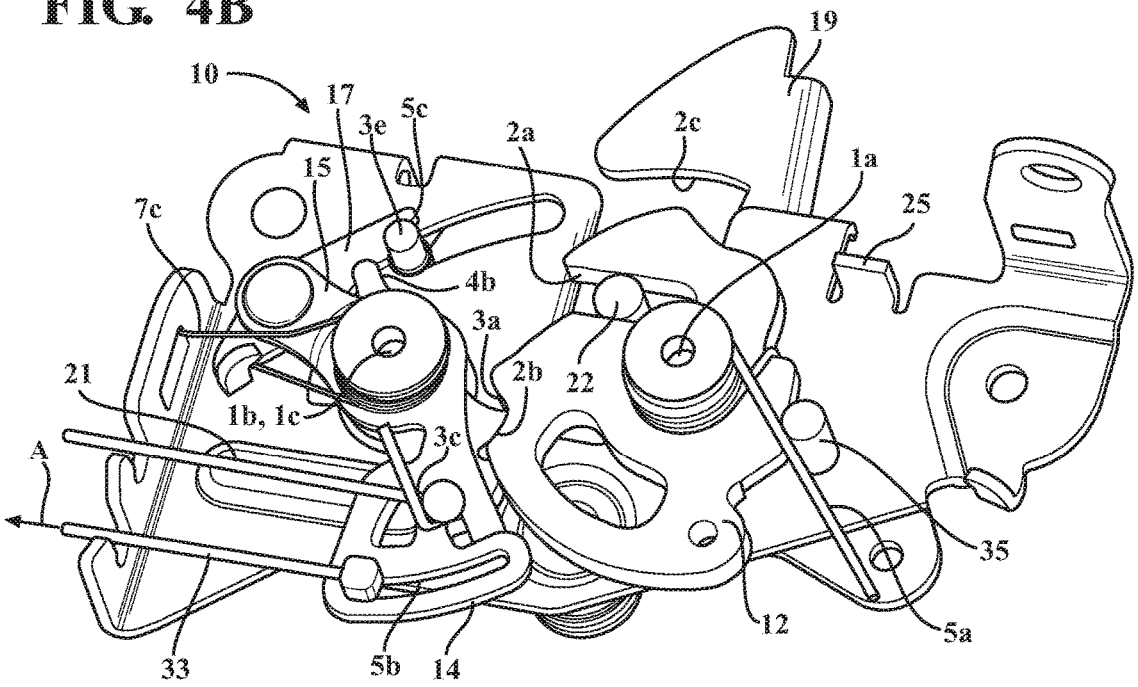

Referring to FIGS. 3I and 3J, after actuation of, and upon release of the linkage 21, the spring member 7*c* acts on the pawl lever 15 and/or the double pull lever 17 to position the pawl lever 15 back into a rest position through pivoting about axis 1*b* and the double pull lever 17 by pivoting about axis 4*c* to engage with the travel block pin 3*e*. It is also noted that the pawl 14 can remain in contact with the ratchet 12 and that in this position, the latch 10 is in position for the second pulling actuation via the linkage 21 along the direction of arrow A in order to intentionally and selectively drive the safety catch member 19 from a closed and locked first position, wherein the safety catch member 19 is in position to obstruct and prevent the striker 22 from releasing from the latch 10, to a second open and completely unlocked position, wherein the safety catch member 19 is moved out of obstruction in relation to the striker 22 to allow the striker 22 to be moved out from engagement with the safety catch member 19 and released from the latch 10, thus positioning the latch 10 in a second open position.

Figure 3K:
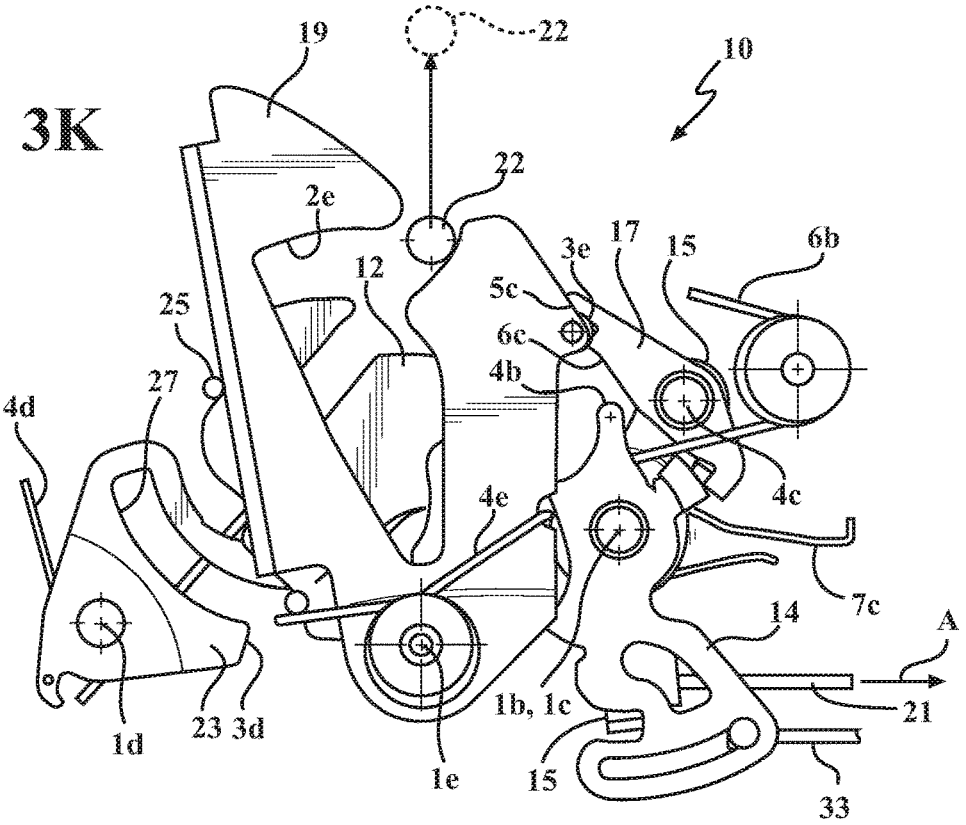
Figure 3L:
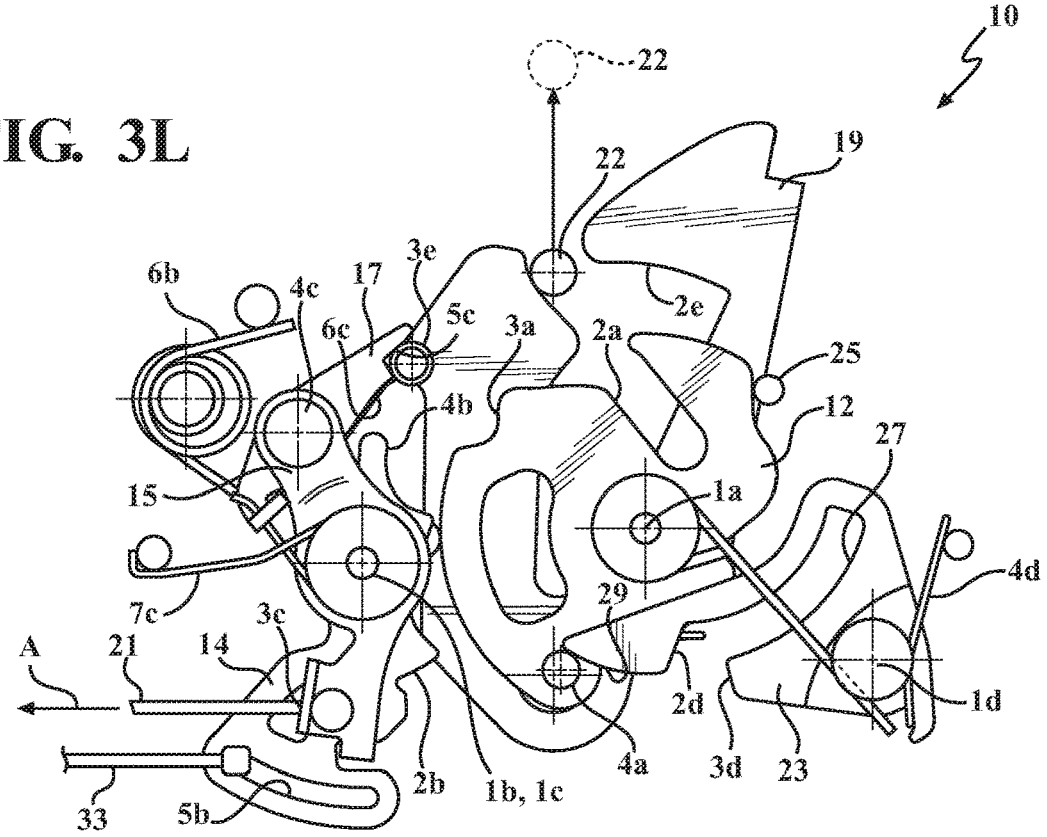

Referring to FIGS. 3K and 3L, as the linkage 21 is actuated and pulled along the direction of arrow A a second time, the pawl 14 is rotated about pivot axis 1*b*, the pawl lever 15 is pivoted about axis 1*c*, and the double pull lever 17 remains engaged with the travel block pin 3*e* of the safety catch member 19 to rotate the safety catch member 19 about pivot axis 1*e* and out of restraining engagement with the striker 22, thus freeing the striker 22 from being retained by the striker safety catch retaining area 2*e*. At this point the latch 10 can be referred to as fully open and the hood 13 can be raised further without interference from the latch 10.

Figure 3M:
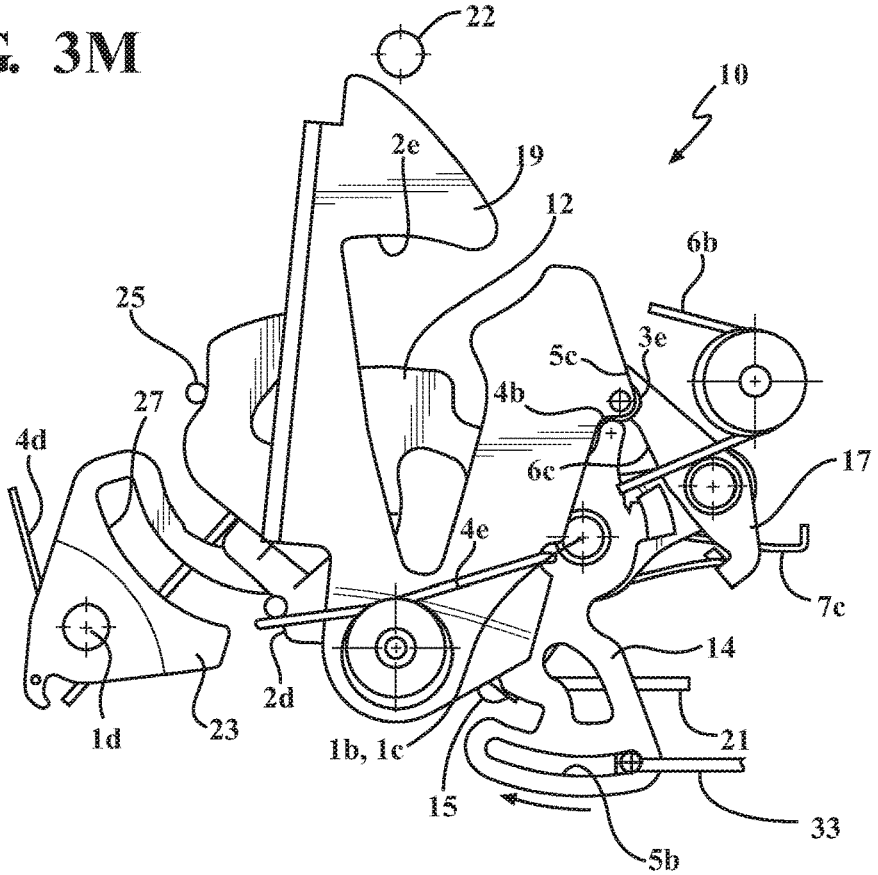
Figure 3N:
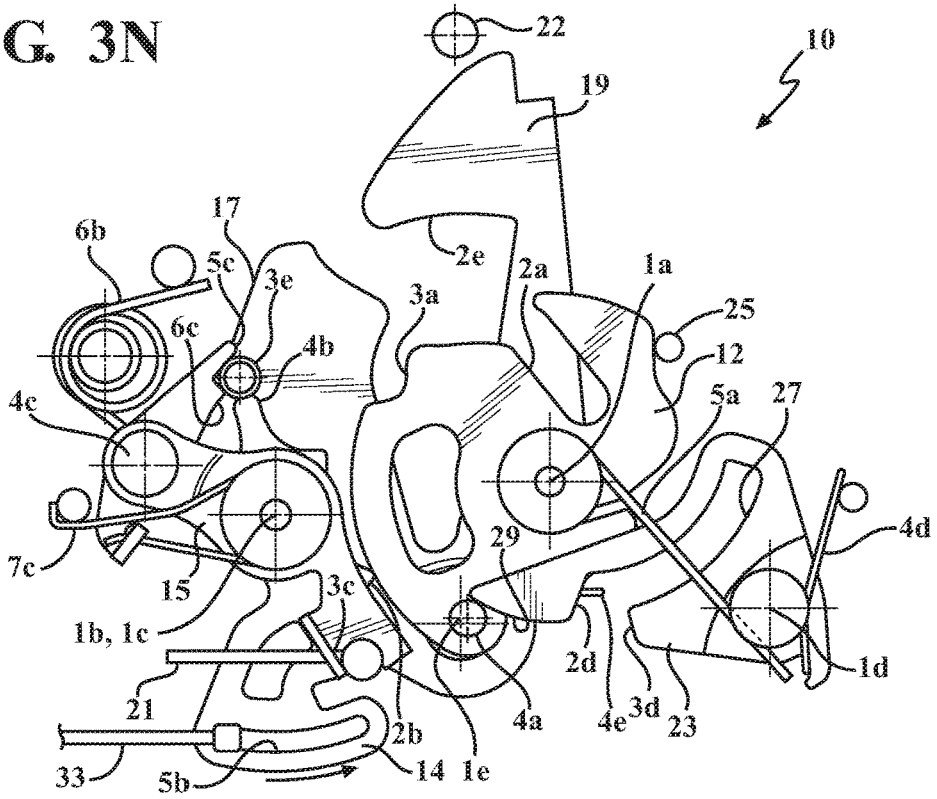

Referring to FIGS. 3M and 3N, upon release of the linkage 21, the pawl 14 returns to its rest position under influence of spring member 6*b*, the ratchet 12 remains open and ready to receive the striker 22 under influence of spring 5*a*, the pawl lever 15 can be released back to its rest position under the influence of spring member 7*c* and the double pull lever 17 remains in contact with the travel block pin 3*e* in cooperation with the abutment surface 5*c* and the double pull lever contact arm 4*b* of the pawl 14. Also noted is that the safety catch member 19 can rotate back about the pivot axis 1*e* under the influence of spring member 4*e*, as desired.

FIGS. 3A-3N show operation of the latch 10 in a passive mode (performed manually by vehicle operator within the vehicle cabin, such as via handle 5) facilitated by multiple actuations of the double pull lever 17 via the linkage 21. The striker 22 can be positioned in a number of positions of the latch 10, such as retained by the ratchet 12, referred to as closed or latched or primary closed position, unrestrained by the ratchet 12 but restrained by the safety catch member 19, referred to as a first open or secondary closed restrained or secondary closed position, and unrestrained by both the ratchet 12 and the member 19, referred to as second open or completely open position.

The ratchet 12 is pivotally connected to the housing 20 and is movable between a closed position and an open position. The pivotal movement of the ratchet 12 may take place about the axis 1*b* provided by a pin that is mounted to the housing 20. In the closed position, the ratchet 12 inhibits the withdrawal of the striker 22, which is mounted on the vehicle hood 13 or other closure panel, from the fish-mouth-shaped striker retaining area 2*a*. In the open position, the striker 22 is released from the striker retaining area 2*a* and allowed to be brought into retained engagement with the safety catch surface 2*e* of the safety catch member 19, and further, when the safety catch member 19 is pivoted to a fully released and open position, the striker 22 is generally free such that the hood 13 may be fully opened.

In one example, a body of the ratchet 12 can have a hook-shaped portion forming an upper portion of the fish-mouth-shaped striker retaining area 2*a* for preventing release of the striker 22 from the retaining area 2*a* when the pawl 14 and ratchet 12 are in the primary closed position. The secondary closed position of the latch 10 is defined as the position when the striker 22 is outside of the striker retaining area 2*a*, while at the same time being restricted from upward movement along the Z-direction by a hooked nose portion 48 of the safety catch member 19 from leaving the latch 10 (i.e. placing the latch 10 in an open state). The ratchet 12 is biased toward the open position by the ratchet biasing member, also referred to as release spring 5*a*. The ratchet biasing member 5*a* may be, for example, a torsion spring. The torsion spring 5*a* may extend around a pin and may have a first end anchored in a slot of the pin and a second end that fixedly engages the ratchet 12. The pawl 14 is pivotally attached to the housing 20 and is movable between a primary locking or closed position, a secondary locking or closed position and an open unlocking position.

Referring to FIGS. 3A-3N, the double pull operation of the linkages 21 is facilitated by the double pull lever 17 pivoted on the pawl lever 15. This double pull lever 17 doesn't engage the safety catch member 19 with substantial force during the first actuation of linkage 21 (e.g. first manual pull of handle 5), rather the double pull lever 17 forcibly engages the safety catch member 19 during a second actuation of the double pull lever 17 via linkage 21 (e.g. second manual pull of handle 5) after the double pull lever 17 returns to a rest position after the first actuation. As such, it is anticipated that the linkage 21 acted upon by the first actuation is allowed to come to rest by a pause (also referred to as an absence or substantial absence in force on the linkage 21 or reduction in force as compared to forces applied in the first and second activations), and then the linkage 21 is acted upon a second time after the pause. After the first activation, the ratchet 12 is disengaged from the pawl 14 under the bias of the spring member 5*a* and the striker 22 is then released from the striker retaining area 2*a* of the ratchet 12 and is then contained by the safety catch member 19 against the striker retaining area 2*e* (while the striker retaining area 2*e* blocks travel of the striker 22 such that the hood 13 is prevented from opening). The second activation imparted on the linkage 21 releases the striker 22 from being contained by the safety catch member 19 by forcing rotation of the safety catch member 19 about the pivot axis 1*e*, thereby moving the striker retaining area 2*e* out of engagement with the striker 22 and allowing unrestrained movement of the striker 22 and hood 13 fixed thereto.

A pop-up system 31 (see FIG. 1B—for example, a mechanical and/or electrical and/or chemically actuated crash system) can be located on the vehicle 11 in order to maintain the hood 13 in an unlatched position (e.g. after the first activation and/or after the second activation of the double pull lever 17). The pop-up system 31, including a sensor configured in operable communication with an actuator, can be attached to the hood 13 and/or any of the latch components 12, 14, 17, 19, 21, 23. Accordingly, it is to be recognized that the pop-up system 31 could be on or adjacent to the hood 13 and/or integrated on the latch 10 as desired.

Referring to FIGS. 4A and 4B, respectively shown are a passive embodiment of the latch 10 and an active embodiment of the latch 10. In the passive embodiment, the latch 10 is configured to be actuated manually by linkage 21 connected to the pawl lever 15 for a double actuation operation, such that in advance of the first actuation of the linkage 21 the double pull lever 17 is disengaged from the safety catch member 19, i.e. the safety catch abutment surface 5*c* is out of engagement/alignment with the travel block pin abutment 3*e* of the safety catch member 19. Only after a manual first actuation of the linkage 21 along the direction of arrow A is the safety catch abutment surface 5*c* put into engagement/alignment with the travel block pin abutment 3*e* of the safety catch member 19 so that the double pull lever 17 can force rotation of the safety catch member 19 about the pivot axis 1*e* during the second actuation of the linkage 21. In contrast, in the active embodiment of FIG. 4B, the latch 10 is configured to be automatically actuated by a second actuator linkage, referred to hereafter as second linkage, active linkage or linkage 33, connected to the pawl 14 in a single actuation mode, such that in advance of the single or first actuation of the linkage 33 along the direction of arrow A, the double pull lever 17 is engaged with the safety catch member 19, i.e. the safety catch abutment pin 5*c* is in engagement/alignment with the travel block pin abutment 3*e* of the safety catch member 19. In the active embodiment, the block element 23 can be, and is shown as being replaced by a blocking abutment 35 to restrict over travel of the striker 22 via over rotation of the ratchet 12 upon closing of the latch 10. The linkage 33 can be coupled to the pawl 14 via a slot or groove 5*b* in the pawl 14, thus providing for unhindered movement of the pawl 14 about the pivot axis 1*b* during normal operation of the latch 10, i.e. during the manual passive mode operation of the latch 10 as described above. For example, the linkage 33 could be automatically actuated by the actuator of the pop up system 31 when a potential crash condition is sensed by an associated sensor (not shown) configured in operable communication with the actuator, which in turn is configured in operable communication with the linkage 22, thereby automatically, upon actuation of the linkage 33 by the pop up system 31 independent of manual operation of the linkage 21. Actuation of the linkage 33 provides for release of the striker 22 to the first open position (in the event that the safety catch member 19 is not removed from blocking exit of the striker 22), which in turn provides increased space between the hood 13 and the underlying engine, thereby providing enhanced cushion or dampening should a pedestrian impact the hood 13, or to the second open position (in the event that the safety catch member 19 is removed from blocking exit of the striker 22) via biasing influence of the double pull lever 17 on the safety catch member 19.

Figure 4C:
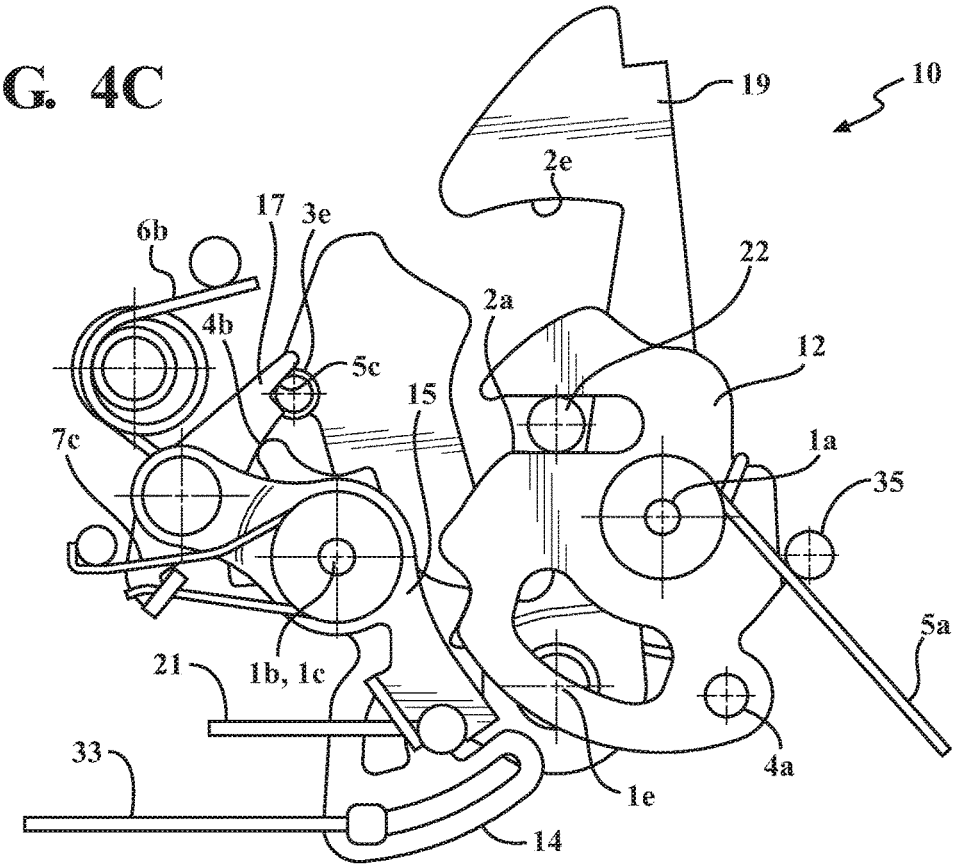
Figure 4D:
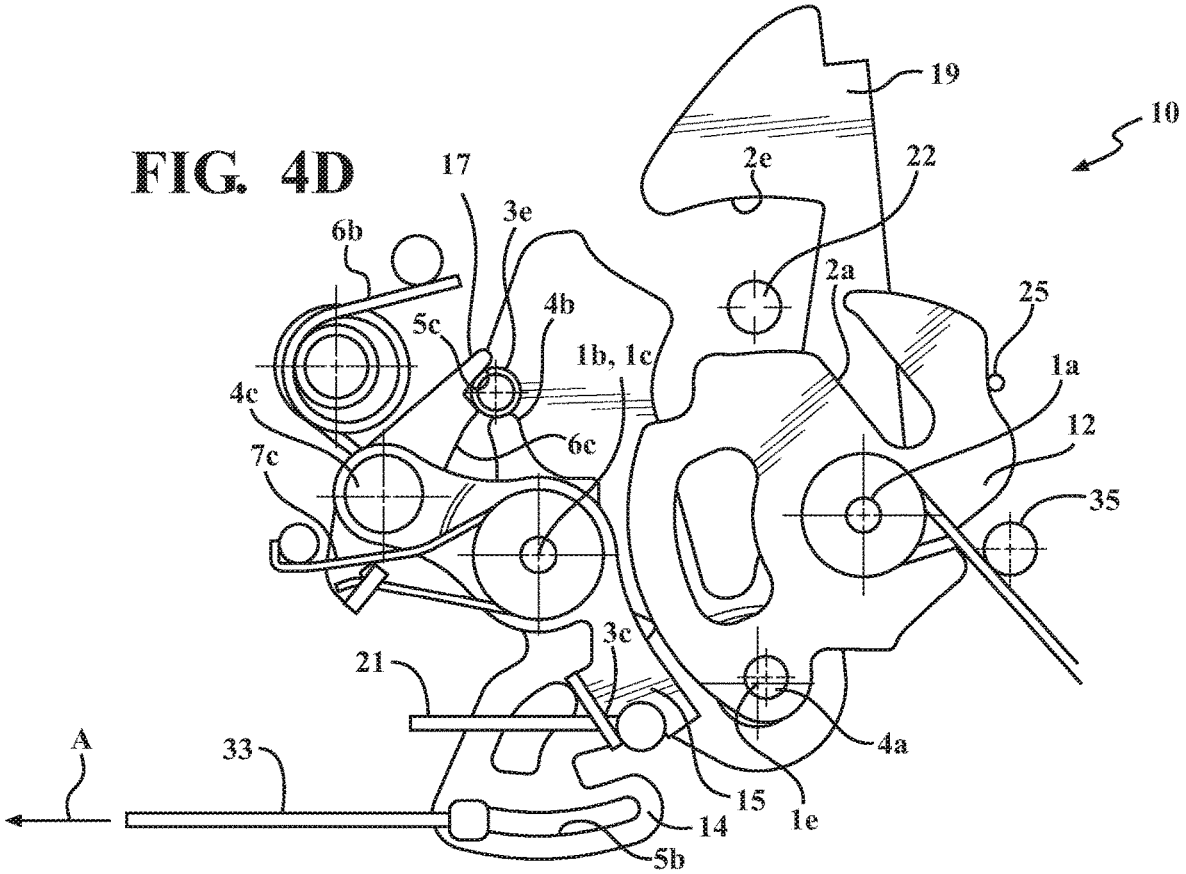

Referring to FIG. 4C, the linkage 21 is coupled to the pawl lever 15 for the passive mode operation and the linkage 33 is coupled to the pawl 14 for the active mode operation. As shown, the latch 10 is in the closed or latched position with the double pull lever 17 engaged with the safety catch member 19 via the travel block pin abutment 3*e*. Referring to FIG. 4D, the linkage 33 has been activated (e.g. pulled along the direction of arrow A), causing simultaneous co-rotation of the pawl 14 and the double pull lever 17 about the pivot axis 1*b*. It is recognized that the co-rotation of the pawl 14 and the double pull lever 17 about the pivot axis 1*b* can occur while the relative orientation (i.e. angular) between the pawl lever 15 and the double pull lever 17 about the pivot axis 4*c* remains constant, i.e. the double pull lever 17 does not rotate about the pivot axis 4*c* while the double pull lever 17 and the pawl lever 15 rotate about the pivot axis 1*b*. The inhibition of rotation of the double pull lever 17 during the first actuation of the pawl 14 is facilitated by the travel block pin abutment 3*e* remaining engaged with abutment surface 5*c* and through contact of the travel block pin abutment 3*e* by the pull lever contact arm 4*b*.

Figure 4E:
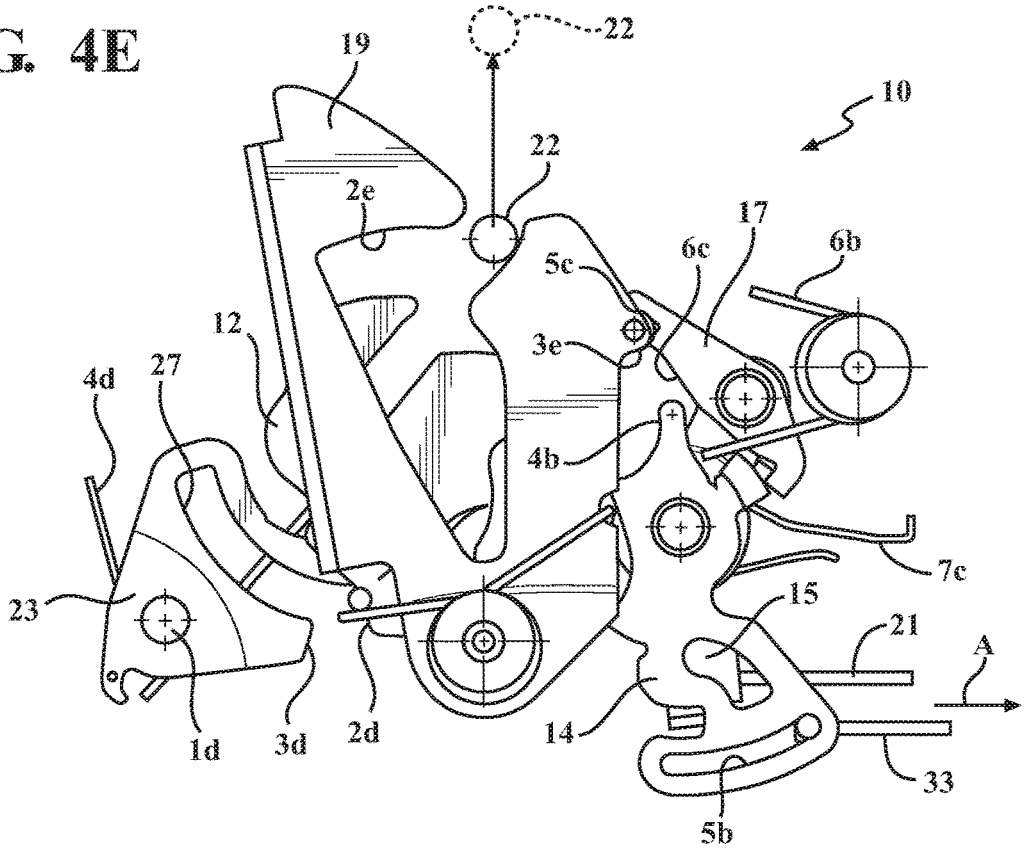
Figure 4F:
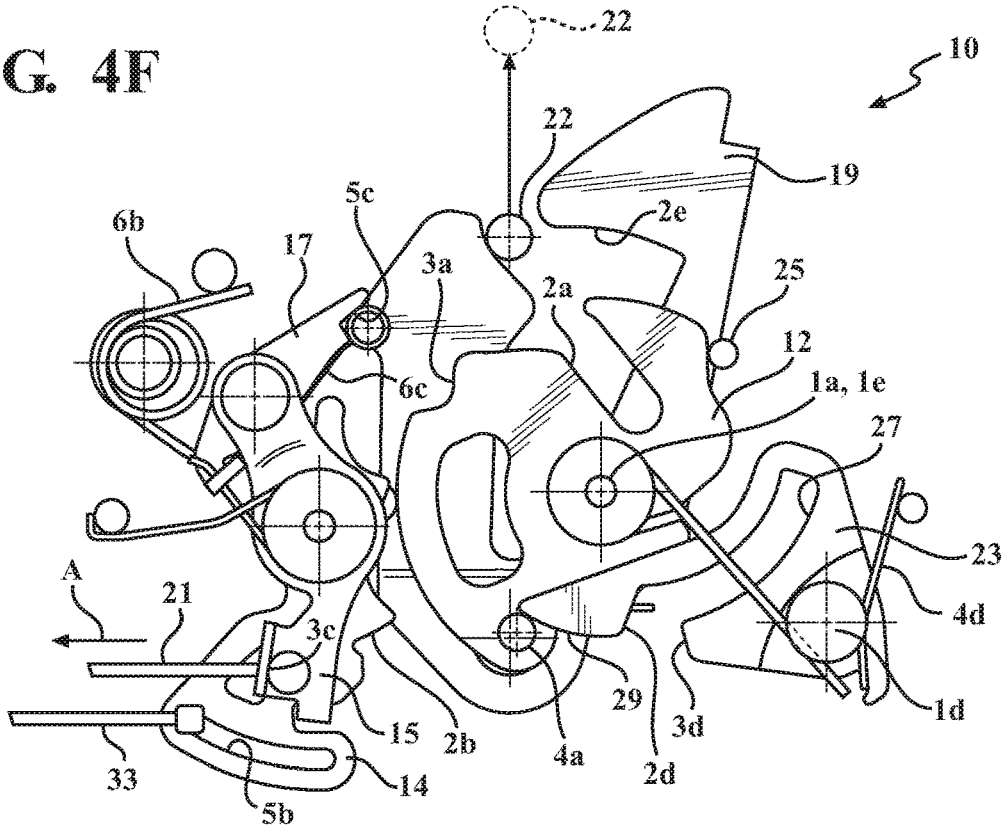

Referring to FIG. 4D, any further actuation of the linkage 33 during the first actuation could cause the safety catch member 19 to rotate out from its safety latch protective position and allow the striker 22 to move from the first open position (FIG. 4D) to the second open position (FIG. 4E). It is recognized that in either of the first open position shown in FIG. 4D or the second open position shown in FIG. 4E, the hood 13 is free to absorb any movement caused by impact, such as with a pedestrian or other object, thereby forcing the hood 13 to move from the open position (first or second) and back toward the closed or latched position.

As shown in FIGS. 4A-4F, a latch 10 having a housing 20, a ratchet 12 mounted on the housing 20 for pivoting about a first pivot axis 1*a*, a pawl 14 mounted on the housing 20 for pivoting about a second pivot axis 1*b* and biased into engagement with the ratchet 12, a pawl lever 15 mounted on the housing 20 for pivoting about a third pivot axis 1*c* and for engaging with the pawl 14 to rotate the pawl 14 about the second pivot axis 1*b*, a double pull lever 17 mounted on the pawl lever 15 for pivoting about a fourth pivot axis 4*c* and for interacting with a safety catch member 19, a linkage 21 coupled to the pawl lever 15 for acting in a passive mode on the pawl lever 15 to disengage the pawl 14 from the ratchet 12 through a first actuation of the linkage 21, and a linkage 33 coupled to the pawl 14 for acting in an active mode on the pawl 14 to disengage the pawl 15 from the ratchet 12 through a first actuation of the linkage 33. The latch 10 can have the linkage 33 configured for acting on the pawl 14 through a continuation (e.g. without pause) of the first actuation of the linkage 33 to drive the double pull member 17 about the second pivot axis 1*c* to drive rotation of the safety catch member 19 about a fifth pivot axis 1*e* of the housing 20 in order to position the striker 22 in the second open position. As such, FIGS. 4A-4E show various operations of a pedestrian actuator (e.g. linkage 33) directly linked to the pawl 14.

Figure 5A:
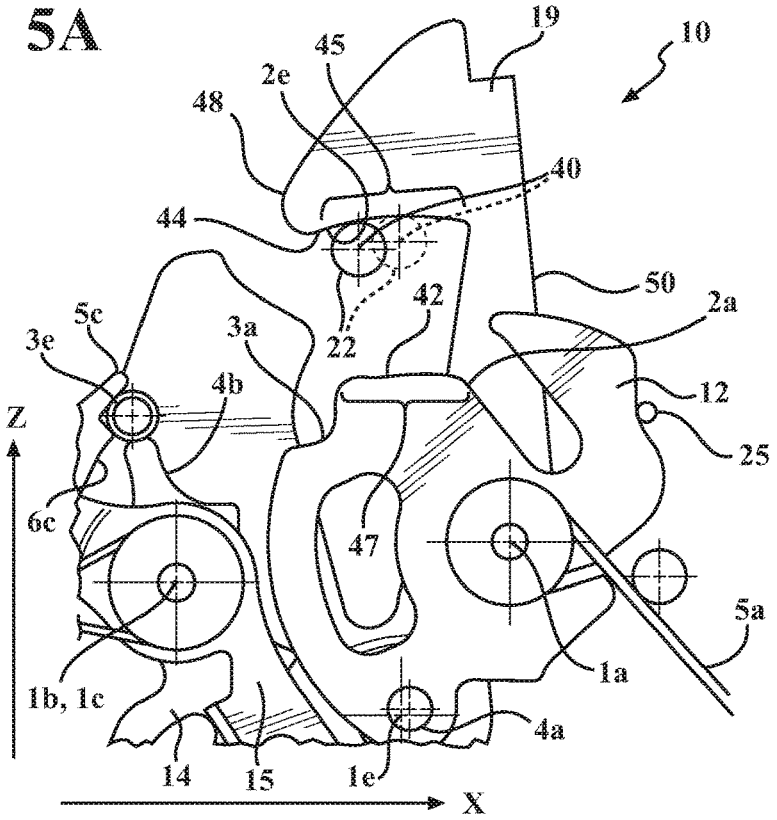
FIGS. 5A and 5B show an example of striker position variability with respect to the latch components of FIG. 1A.
Figure 5B:
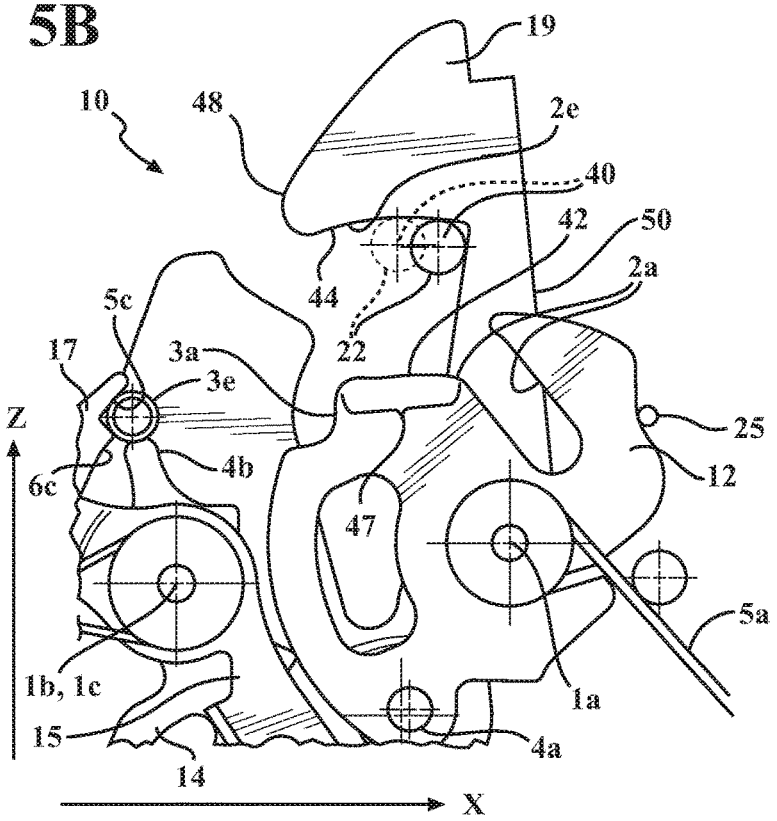

Referring to FIGS. 5A and 5B, shown is the latch 10 configured to have variable positioning of the striker longitudinal axis 40 along the X axis (either positively or negatively from a desired intermediate position, as desired), as facilitated by the shape profile 42, 44 of both the striker retaining area 2*a* of the ratchet 12 and the striker retaining area 2*e* of the safety catch member 19. Referring to the shape profile 44 of the safety catch member 19, the shape profile 44 has a generally flattened portion 45 (e.g. can be of an approximately linear or arcuate profile) extending between a nose 48 at a proximate end of the safety catch member 19 and an arm 50 connecting the proximate end of the safety catch member 19 to the pivot axis 1*e*. The flattened portion 45 can be shaped so as to retain the striker 22 in various positions along the shape profile 44 after exiting the ratchet 12, depending upon the position of the striker 22 along the X axis with respect to a mounting location (and ultimate positioning of the safety catch member 19) of the latch 10 on the vehicle 11. In one embodiment, the length of the flattened portion 45 from nose 48 to the arm 50 can be between two and three widths of a cross sectional dimension (e.g. diameter) of the striker body, by way of example and without limitation. In another embodiment, the length of the flattened portion 45 from nose 48 to the arm 50 can be between one and two widths of a cross sectional dimension (e.g. diameter) of the striker body, by way of example and without limitation. In yet another embodiment, the length of the flattened portion 45 from nose 48 to the arm 50 can be between one and three widths of a cross sectional dimension (e.g. diameter) of the striker body, by way of example and without limitation.

Referring to the shape profile 42 of the ratchet 12, the shape profile 42 has a flattened portion 47 (e.g. can be of an approximately linear or arcuate profile) extending between the slotted striker retaining area 2*a* and the bottom ratchet retaining area, also referred to as closing notch 3*a* (e.g. cam surface) spaced from the striker retainer area 2*a*. The flattened portion 47 can be shaped so as to retain the striker 22 in various positions along the shape profile 42 before reentering the slotted striker retaining area 2*a* of the ratchet 12 upon closing of the hood 13 and latch 10, depending upon the position of the striker 22 along the X axis with respect to a mounting location (and ultimate positioning of the ratchet 12) of the latch 10 on the vehicle 11. In one embodiment, the length of the flattened portion 42 from slotted striker retaining area 2*a* to closing notch 3*a* can be between two and three widths of a cross sectional dimension (e.g. diameter) of the striker body, by way of example and without limitation. In another embodiment, the length of the flattened portion 47 from slotted striker retaining area 2*a* to closing notch 3*a* can be between one and two widths of a cross sectional dimension (e.g. diameter) of the striker body, by way of example and without limitation. In yet another embodiment, the length of the flattened portion 47 from slotted striker retaining area 2*a* to closing notch 3*a* can be between one and three widths of a cross sectional dimension (e.g. diameter) of the striker body, by way of example and without limitation. It is recognized that preferably both the ratchet 12 and the safety member 19 have cooperating flattened portions 45, 47, so as to facilitate contact of the ratchet 12 by the striker 22 while accounting for positioning tolerances in the X axis to force the ratchet 12 toward the closed latch position, while also to facilitate contact of the safety catch member 19 by the striker 22 when the striker 22 exits the slotted striker retaining area 2*a* of the ratchet 12 and places the latch 10 in the first open position. It is recognized that the cooperating flattened portions 45, 47 are spaced apart and opposite, generally mirrored relation with one another when the latch 10 is in the first open position. Further, it is recognized that the flattened portions 45, 47 are both positioned about an XY plane orientation when the latch 10 is in the first open position.

A latch 10 having a ratchet 12 mounted on the housing 20 for pivoting about a first pivot axis 1*a* and having a ratchet flattened portion 47 extending between a striker retaining area 2*a* and a closing notch 3*a* spaced from the striker retaining area 2*a*, a pawl 14 mounted on the housing 20 for pivoting about a second pivot axis 1*b* and biased into engagement with the ratchet 12, and a safety catch member 19 mounted on the housing 20 for pivoting about a third pivot axis 1*e* of the housing 20 and having a flattened portion 45 extending between a nose 48 at a proximate end of the safety catch member 19 and an arm 50 connecting the proximate end of the safety catch member 19 to the pivot axis 1*e*, wherein the flattened portion 47 facilitates contact of the ratchet 12 by the striker 22 while accounting for positioning tolerances of the striker 22 along the flattened portion 47 to force the ratchet 12 toward a closed latch position and the flattened portion 45 facilitates contact of the safety catch member 19 by the striker 22 when the striker 22 exits the striker retaining area 2*a* of the ratchet 12, placing the latch 10 in the first open position.

Figure 6A:
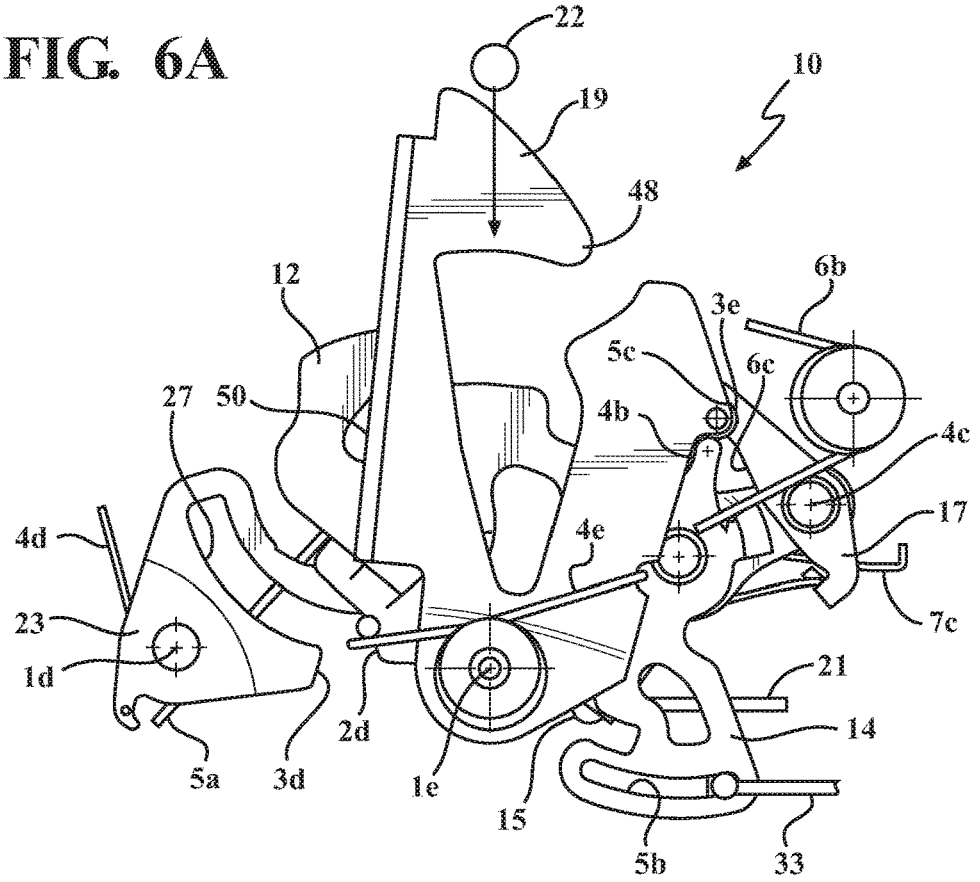
FIGS. 6A, 6C, 6E, 6G, 6I, 6K show a progression of a striker being disposed from an unlatched position external from the latch of FIG. 1A into latched engagement therewith and an example operation of a blocking member of the latch from one side of the latch.
Figure 6B:
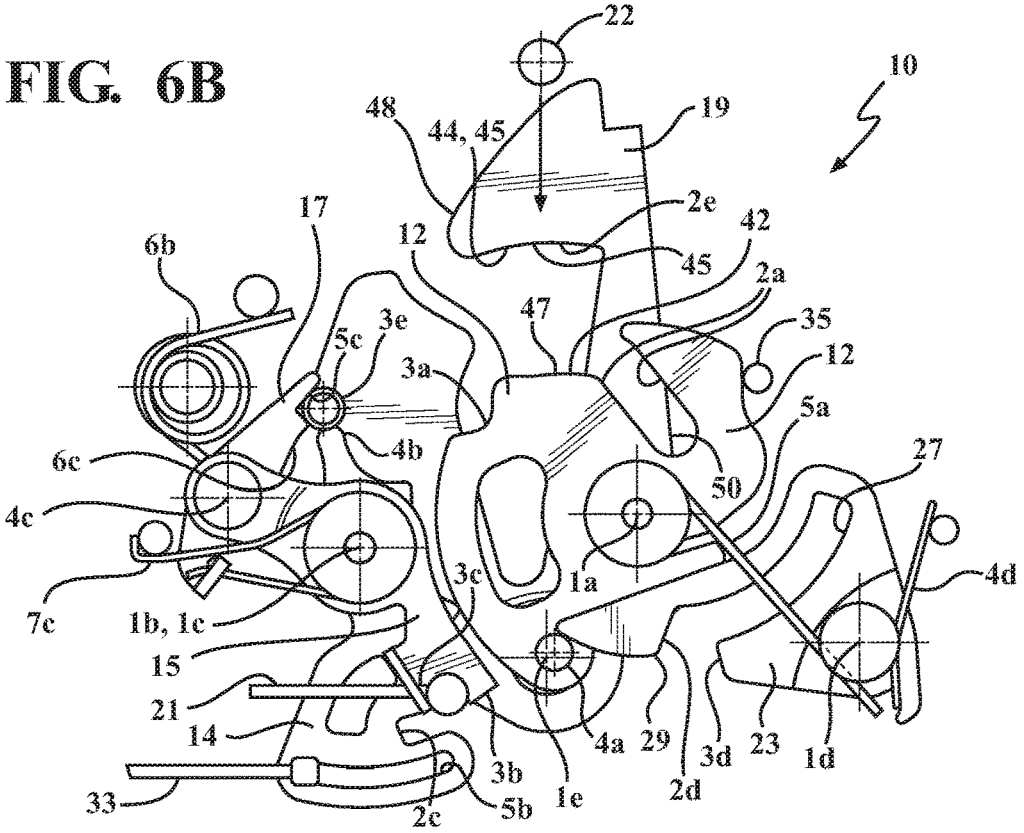
FIGS. 6B, 6D, 6F, 6H, 6J, 6L show a corresponding progression from an opposite of the latch.
Figure 6C:
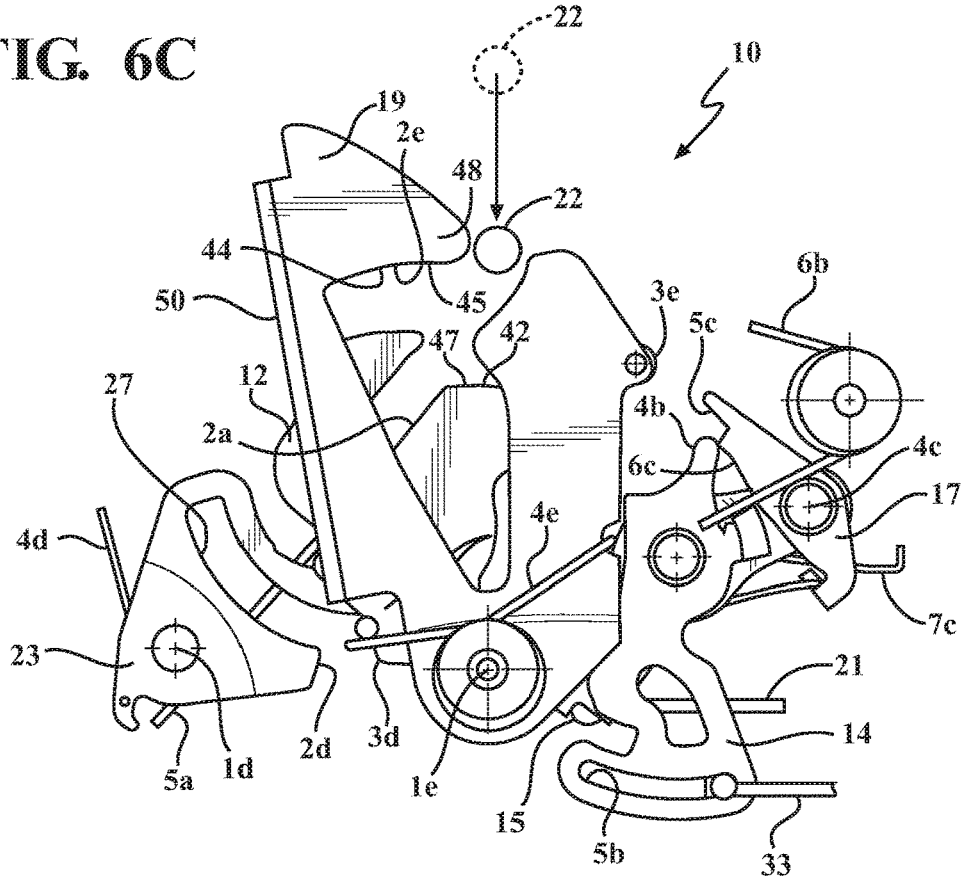
Figure 6D:
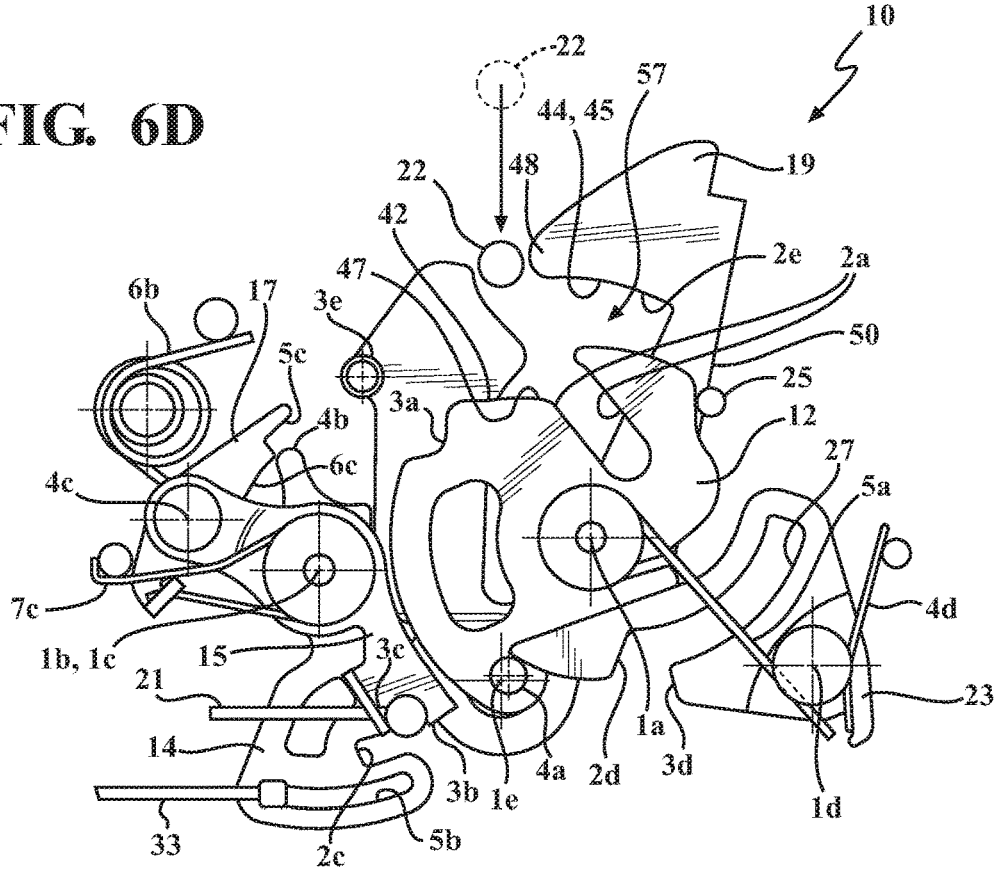

Referring to FIGS. 6A-6L, shown is an operation of the latch 10 when being operated from the second or fully open position toward the closed or latched position. Accommodated for are both conditions for "blocking" any over travel of the ratchet 12 away from the closed position under the influence of the hood 13 momentum (e.g. under the duress of an impact with a pedestrian) as well as for allowing or providing for over travel of the ratchet 12 away from the closed position under the influence of the momentum of the hood 13 (e.g. under the duress of an impact with a pedestrian). In FIGS. 6A and 6B, shown is travel of the striker 22 toward impact with the nose 48 of the safety catch member 19 when the latch 10 is in the second open position (e.g. completely unlocked and fully open). In this orientation, both of the flattened portions 45, 47 are opposed to one another and ready to receive the striker 22. The ratchet 12 is held in this position by an abutment 25, as the spring 5*a* biases the ratchet 12 about the pivot axis 1*a* toward the abutment 25. The extra travel link pin abutment 4*a* of the ratchet 12 is also in contact with the arcuate nose portion 29 of the blocking member 23. In FIGS. 6C and 6D, the striker 22 has contacted the nose 48 of the safety catch member 19 and pushed against the bias of the spring 4E to pivot the safety catch member 19 about the pivot axis 1*e* to cause the striker 22 to enter an interior 57 of the safety catch member 19 containing the flattened portion 45, while the flattened portion 47 is positioned to receive and obstruct the striker 22.

Figure 6E:
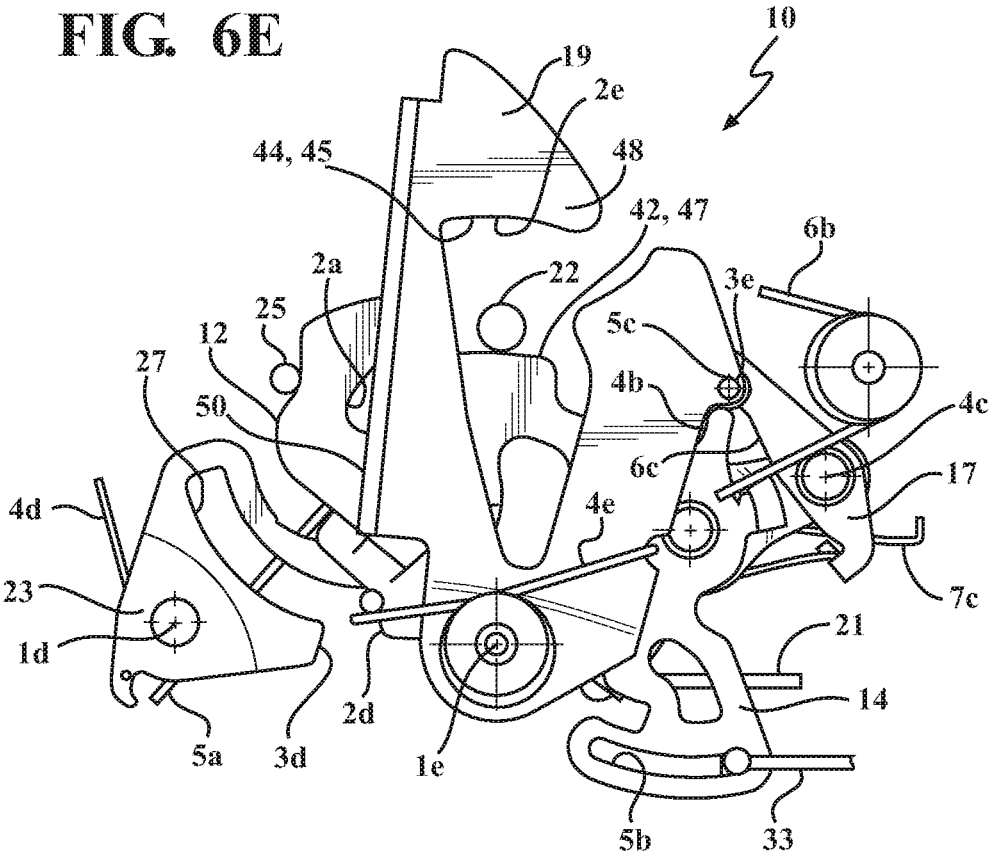
Figure 6F:
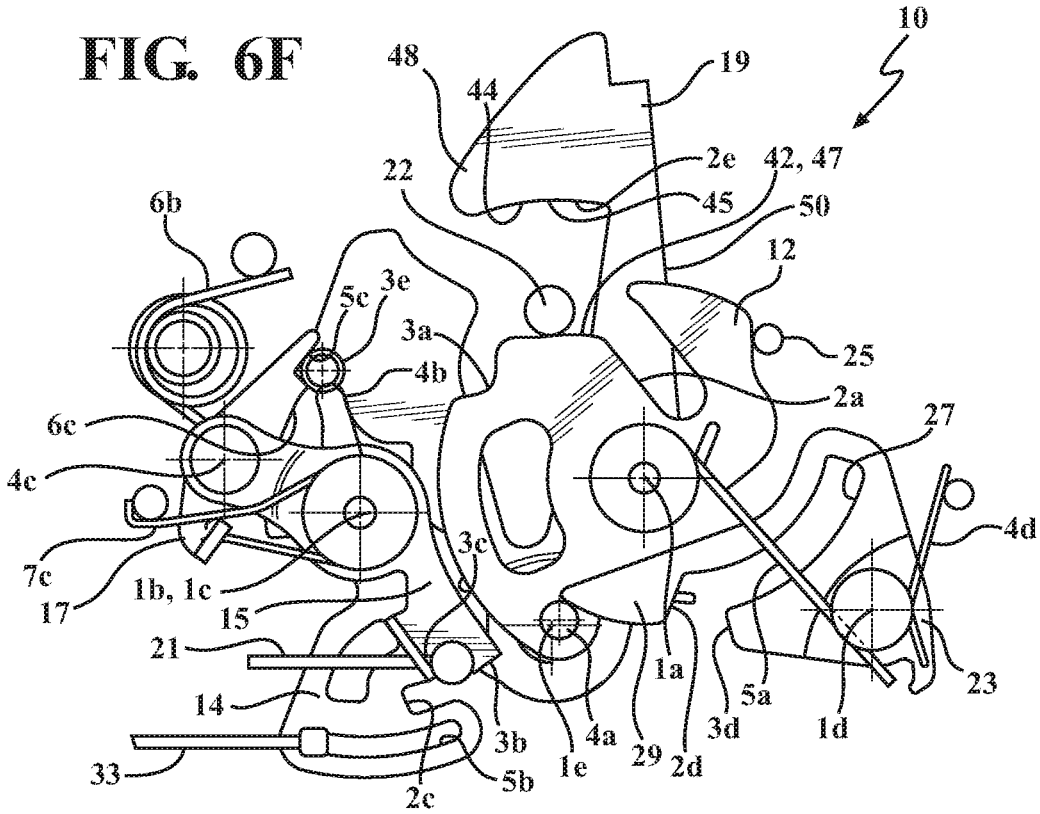
Figure 6G:
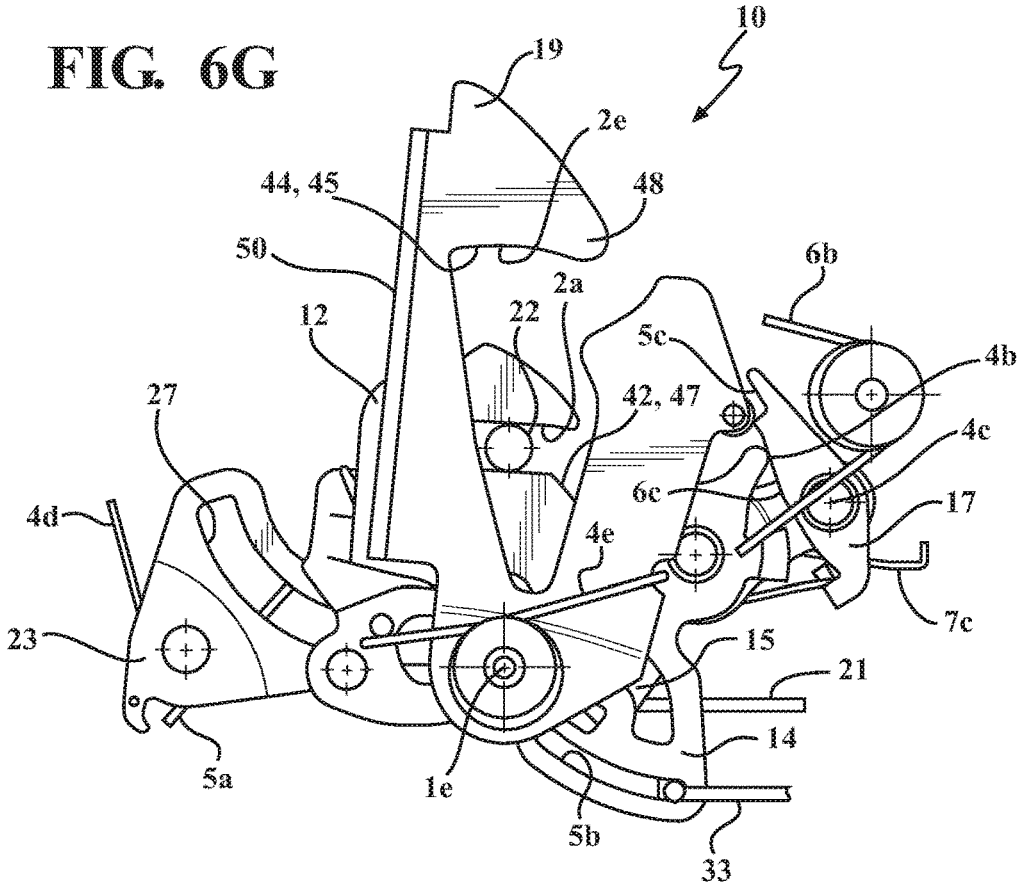
Figure 6H:
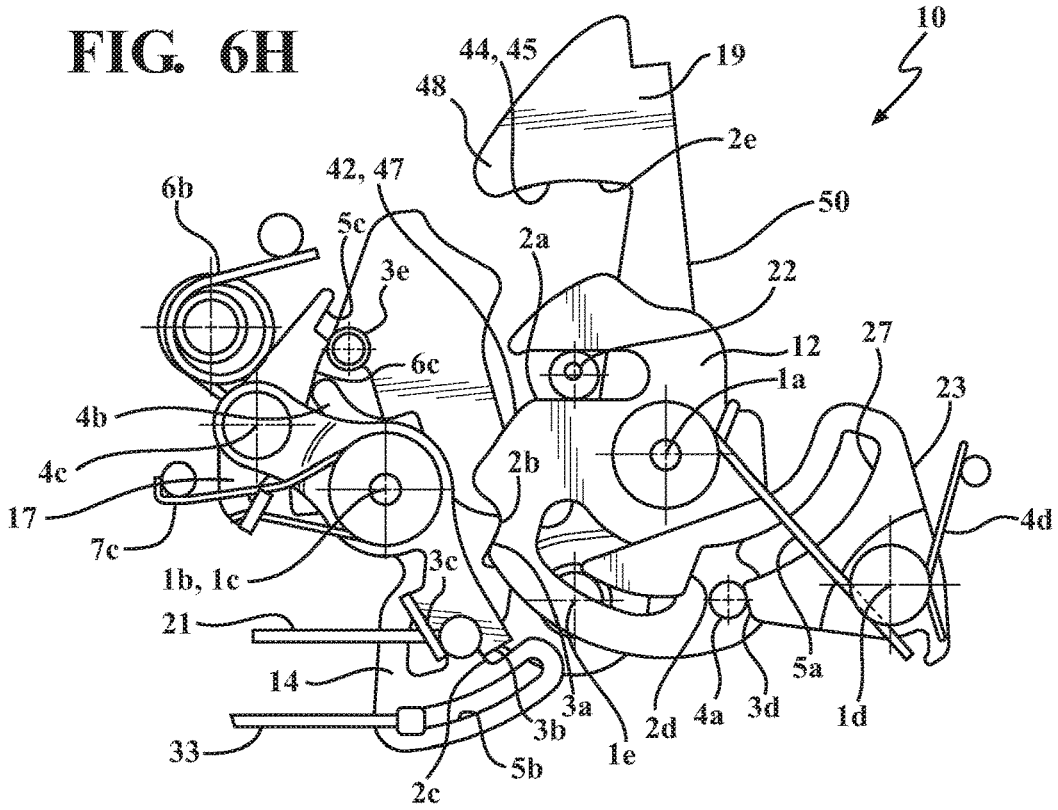
Figure 6I:
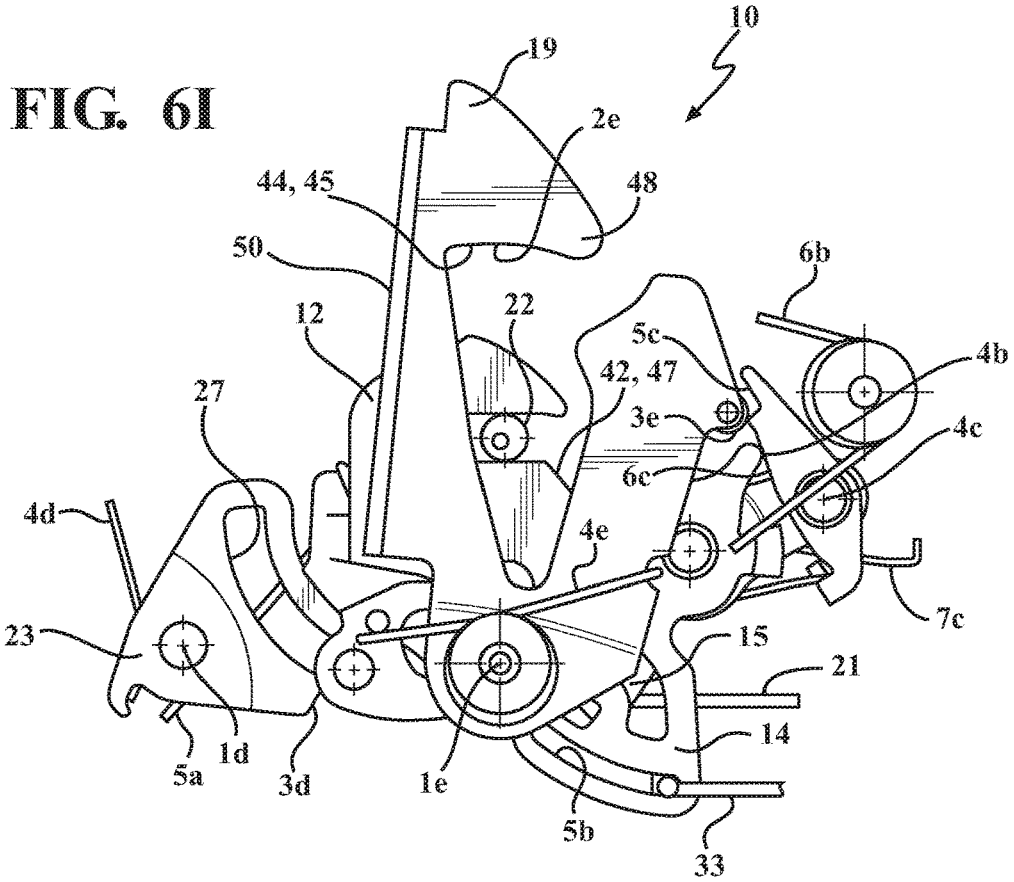
Figure 6J:
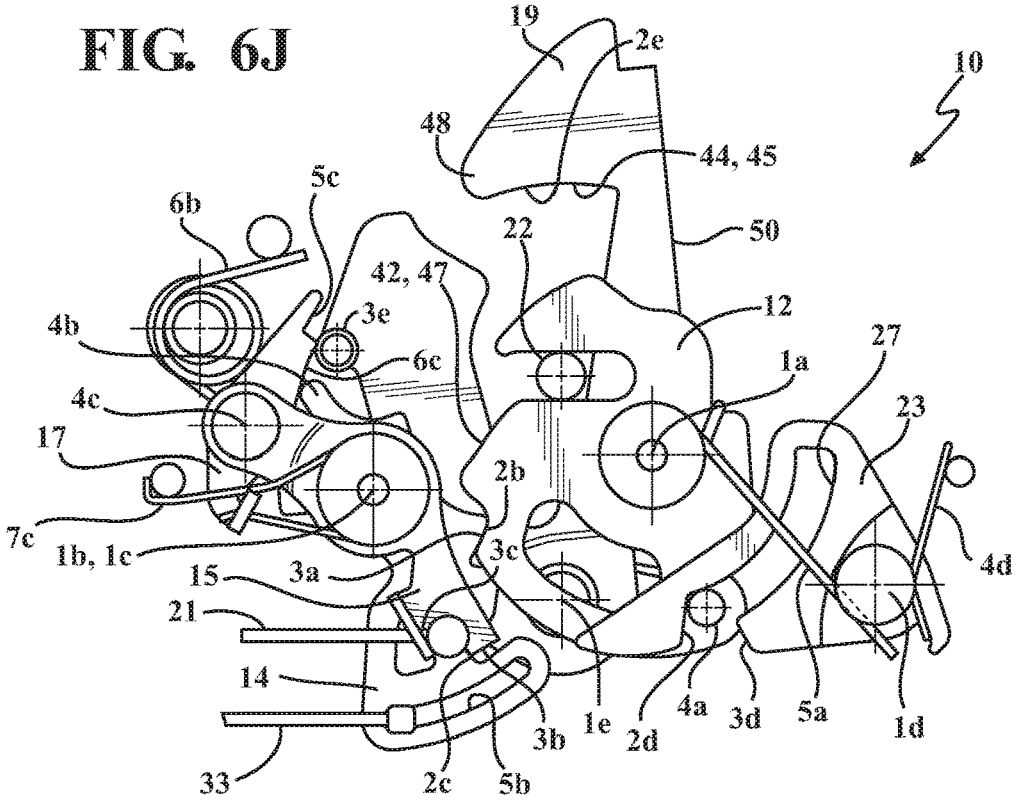
Figure 6K:
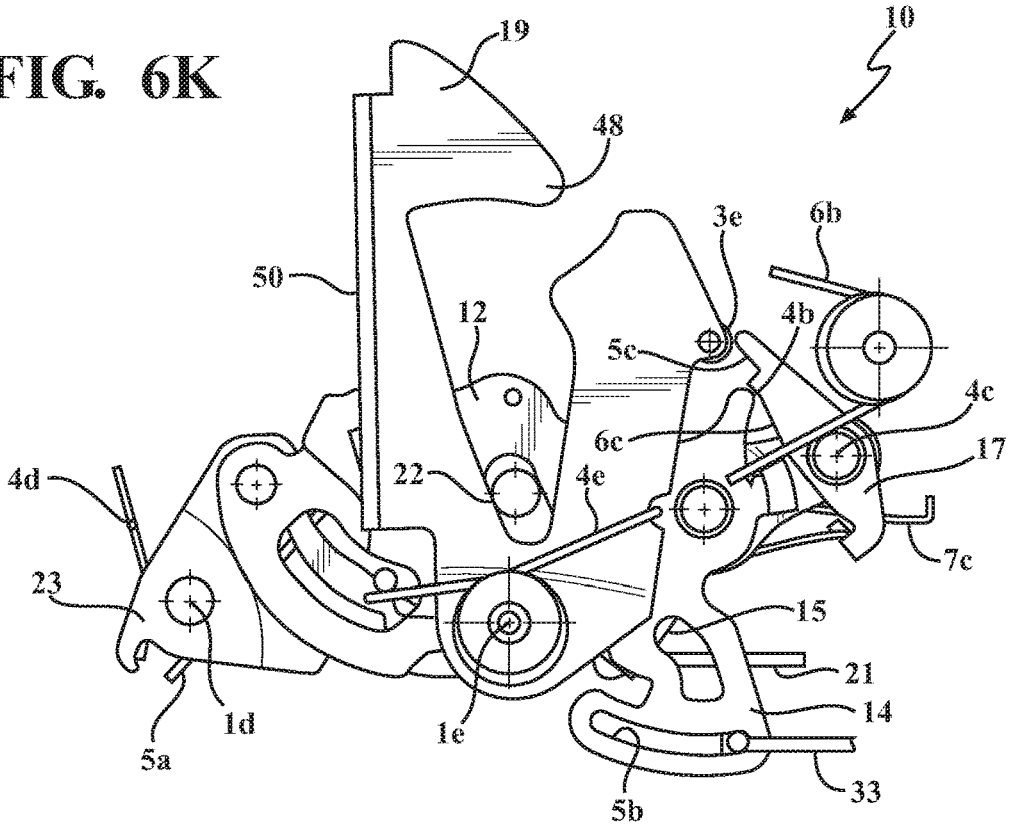
Figure 6L:
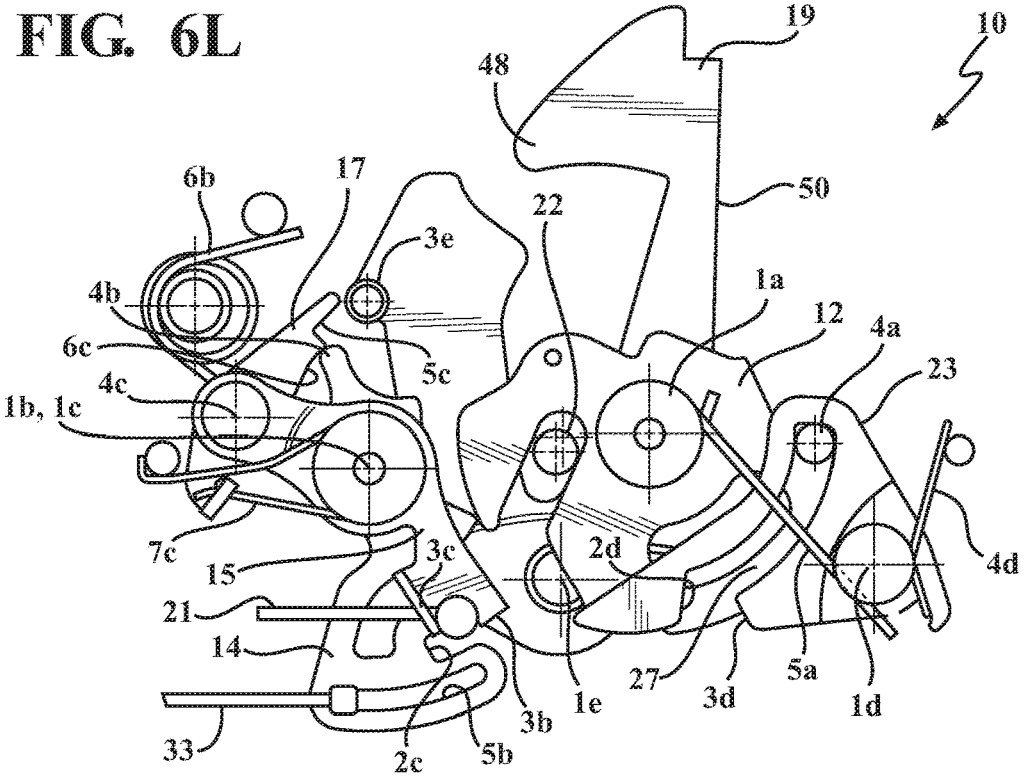

Referring to FIGS. 6E and 6F, the striker 22 contacts the flattened portion 47 of the ratchet 12 causing the ratchet 12 to rotate about the pivot axis 1*a* away from the abutment 25 against the bias of the spring 5*a*. For example, the safety catch member 19 can rotate back into position above the ratchet 12 under the influence of the safety catch member spring 4*e* once the striker 22 loses contact with the safety catch member 19 as it travels past the safety catch member 19 toward the ratchet 12. Referring to FIGS. 6G and 6H, the striker 22 is now retained in the slotted striker retaining area 2*a* of the ratchet 12 and the extra travel link pin abutment 4*a* of the ratchet 12 has moved from the nose portion 29 of the blocking member 23 to come into contact with the extra travel blocking abutment 3*d*. It is noted that in this blocked position, the ratchet 12 is spaced apart from engagement with the pawl 14, i.e. closing notch surface 3*a* and ratchet retaining protrusion 2*b* are out of contact with one another. Further, the blocking abutment 3*d* is sloped away from an entrance of the slot/groove 27, so as to discourage entry of the travel link pin abutment 4*a* into the slot 27 once blocked. In FIGS. 6I and 6J, under influence of the bias of the release spring member 5*a*, ratchet 12 rotates about the pivot axis 1*a* toward the pawl 14 to engage the surfaces 2*b*, 3*a*, thereby placing the ratchet 12 in the closed position. When this occurs, movement of the ratchet 12 removes influence of the sloped surface of the abutment 3*d* from the travel link pin abutment 4*a* of the ratchet 12 and thus, allows the bias of the spring member 4*d* to rotate the blocking member 23 about the pivot axis 1*d* to encourage entry of the travel link pin abutment 4*a* into the slot 27. At this stage, any further travel of the striker 22 against the bias of the release spring member 5*a* will be provided for as over travel by the latch 10 by accommodating travel of the travel link pin abutment 4*a* along the slot 27 toward the end or bottom of the slot (see FIGS. 6K and 6L) without influence of the blocking abutment 3*d* on the travel link pin abutment 4*a*, as forced movement of the striker 22 against the bias of the release spring member 5*a*. It is anticipated that once the force of the striker 22 against the bias of the release spring member 5*a* is abated, the bias of the release spring member 5*a* will return the ratchet 12 into contact with the pawl 14 (see FIGS. 6I and 6J).

Accordingly, the blocking member 23, as part of the latch 10, provides a solution where striker 22 over travel is blocked during a hood 13 closing and provided for when a pedestrian crash occurs. The blocking member 23 can act as a dedicated lever in contact with the ratchet 12 to block the ratchet 12 rotation in case of closing with high speed, then change position about the pivot axis 1*d* through action of the spring 5*a* leaving the ratchet 12 free to rotate in extra travel away from engagement with the pawl 14 in the latch closed position, as compared to rotation of the ratchet 12 toward the pawl 12 toward the closed position from the open position (first or second) when normal travel (defined as travel of the striker 22 between the closed and open positions) of the striker 22 is experienced by the latch 10 components.

The above-described embodiments of the invention are intended to be examples of the present invention and alterations and modifications may be effected thereto, by those of skill in the art, without departing from the spirit of the invention, which is ultimately defined by the broadest interpretation of allowed claims related to this disclosure.

What is claimed is:

1. A latch, comprising:

a housing;

a ratchet mounted on the housing for pivoting about a first pivot axis between a locked, closed position for capturing a striker and an unlocked, open position for releasing the striker;

a pawl mounted on the housing for pivoting about a second pivot axis between a first position in locked engagement with said ratchet to hold the ratchet in the locked, closed position and a second position out of locked engagement with said ratchet to allow the ratchet to pivot to the unlocked, open position, said pawl being biased into said first position;

a pawl lever mounted on said housing for pivoting about a third pivot axis, said pawl lever being configured to engage said pawl to rotate said pawl about said second pivot axis from said first position to said second position;

a double pull lever mounted on the pawl lever for pivoting about a fourth pivot axis, said double pull lever having an abutment surface; and a safety catch member mounted on the housing for pivoting movement about a fifth pivot axis and being configured for selective engagement with said abutment surface of said double pull lever in response to said pawl lever being pivoted about the third axis to pivot said safety catch member from a locked first position, whereat the safety catch member is in position to obstruct movement of the striker from releasing from the latch, to an unlocked second position, whereat the safety catch member is moved out of obstruction in relation to the striker to allow the striker to be released from the latch.

2. The latch of claim 1 wherein said third pivot axis and said fourth pivot axis are spaced apart from one another along said pawl lever.

3. The latch of claim 1 further including a first linkage connected to said pawl lever, said first linkage being configured to act on said pawl lever to rotate said pawl from said first position to said second position through a first actuation of said first linkage.

4. The latch of claim 3 wherein said first linkage is configured to act on said pawl lever through a second actuation of said first linkage to drive said double pull lever about said third pivot axis to pivot said safety catch member about said fifth pivot axis and move said safety catch member from said locked first position to said unlocked second position.

5. The latch of claim 3 further including a second linkage connected to said pawl, said second linkage being configured to act on said pawl to rotate said pawl from said first position to said second position through a first actuation of said second linkage.

6. The latch of claim 5 wherein said second linkage is configured for automated actuation to automatically cause said second linkage to act on said pawl independent from said first linkage.

7. The latch of claim 6 wherein said first linkage is manually actuatable.

8. The latch of claim 1 wherein said pivoting of said pawl lever about said third axis is independent of said pivoting of said double pull lever about said fourth axis.

9. The latch of claim 1 wherein said second pivot axis and said third pivot axis are coaxial.

10. The latch of claim 1 further including a contact surface extending from a body of said pawl for selectively inhibiting the engagement of said abutment surface of said double pull lever with said safety catch member.

11. The latch of claim 1 further including a common biasing member for biasing said pawl lever and said double pull lever.

12. The latch of claim 1 wherein said ratchet has an abutment surface and further including a blocking member mounted on said housing for pivoting about an axis spaced from said second pivot axis, said blocking member having a blocking surface configured to confront said abutment surface to inhibit pivoting of said ratchet.

13. The latch of claim 12 wherein said blocking member has an elongate slot adjacent said abutment surface, said elongate slot being configured to receive said abutment when said ratchet pivots past a closed position of the latch.

14. The latch of claim 13 wherein said blocking member has an arcuate surface at a leading end of said slot for guiding said abutment in to and out of said slot.

15. The latch of claim 12 further including a spring biasing said blocking member in a rotational direction opposite a biased rotational direction of said ratchet.

16. A latch, comprising:

a housing;

a ratchet mounted on said housing and being pivotal about a first pivot axis between a locked, closed position for capturing a striker and an unlocked, open position for releasing the striker;

a pawl mounted on said housing, said pawl being pivotal about a second pivot axis into biased engagement with said ratchet to hold the ratchet in the locked, closed position;

a pawl lever mounted on said housing, said pawl lever being pivotal about a third pivot axis for engagement with said pawl to rotate said pawl about said second pivot axis;

a first linkage coupled to said pawl lever, said first linkage being actuatable to disengage said pawl from said ratchet during a first actuation of said first linkage to release said ratchet for movement to the unlocked, open position; and a second linkage directly linked to said pawl, said second linkage being operable to disengage said pawl from said ratchet through a first actuation of said second linkage by an actuator independent of said first linkage to release said ratchet for movement to the unlocked, open position.

17. The latch of claim 16 wherein said ratchet has an abutment surface and further including a blocking member mounted on said housing for pivoting about an axis spaced from said second pivot axis, said blocking member having a blocking surface configured to confront said abutment surface to inhibit pivoting of said ratchet.

18. The latch of claim 17 wherein said blocking member has an elongate slot adjacent said abutment surface, said elongate slot being configured to receive said abutment when said ratchet pivots past a closed position of the latch.

19. A latch for a vehicle hood, comprising:

a housing;

a ratchet mounted on said housing for pivoting about a first pivot axis between a locked, closed position for capturing a striker and an unlocked, open position for releasing the striker, said ratchet having an abutment extending therefrom;

a pawl mounted on said housing for pivoting about a second pivot axis and biased into engagement with said ratchet to hold the ratchet in the locked, closed position; and a blocking member mounted on said housing for pivoting about a third pivot axis and biased into engagement with said ratchet, said second pivot axis and said third pivot axis being spaced apart from one another, said blocking member having a command surface for interacting with said abutment and having a blocking surface for inhibiting pivoting of said ratchet beyond the locked, closed position when in contact with said abutment, and having a slot configured to receive said abutment when said abutment moves out of contact from said blocking surface and said ratchet pivots past the locked, closed position-to an overtravel position of the latch;

wherein the blocking surface inhibits movement of the ratchet toward the overtravel position and toward an end of the slot that is opposite the command surface.

20. The latch of claim 19 wherein said blocking member has an arcuate surface at a leading end of said slot for guiding said abutment in to and out of said slot.

21. The latch of claim 19 further including a spring biasing said blocking member in a rotational direction opposite to a rotational direction pertaining to the bias of said ratchet.

22. The latch of claim 16 further including a safety catch member mounted on the housing for pivoting movement about a fourth pivot axis from a locked first position, whereat the safety catch member is in position to obstruct movement of the striker from releasing from the latch, to an unlocked second position, whereat the safety catch member is moved out of obstruction in relation to the striker to allow the striker to be released from the latch, wherein said second linkage is operable to cause said safety catch member to pivot from the locked first position to the unlocked second position during said first actuation of said second linkage.

* * * * *